US006822631B1

(12) United States Patent
Yatabe

(10) Patent No.: US 6,822,631 B1
(45) Date of Patent: Nov. 23, 2004

(54) SYSTEMS AND METHODS FOR DRIVING A DISPLAY DEVICE

(75) Inventor: Satoshi Yatabe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 714 days.

(21) Appl. No.: 09/869,972

(22) PCT Filed: Nov. 20, 2000

(86) PCT No.: PCT/JP00/08187

§ 371 (c)(1),
(2), (4) Date: Jul. 10, 2001

(87) PCT Pub. No.: WO01/39166

PCT Pub. Date: May 31, 2001

(30) Foreign Application Priority Data

Nov. 19, 1999 (JP) ..... 11-329984

(51) Int. Cl.[7] ..... G09G 3/36

(52) U.S. Cl. ..... 345/89; 345/213; 345/96; 345/207

(58) Field of Search ..... 345/213, 204, 345/100, 89, 99, 94–96, 208, 210, 88, 209, 691, 692, 690

(56) References Cited

FOREIGN PATENT DOCUMENTS

| | | |
|---|---|---|
| JP | A 58-72191 | 4/1983 |
| JP | A 2-135419 | 5/1990 |
| JP | A 8-44317 | 2/1996 |
| JP | A 8-160392 | 6/1996 |
| JP | A 9-244591 | 9/1997 |

*Primary Examiner*—Lun-Yi Lao
(74) *Attorney, Agent, or Firm*—Oliff & Berridge, PLC

(57) ABSTRACT

In order to reduce power consumption in halftone display, each horizontal scanning period for which one of a plurality of scanning lines is selected is divided into first and second half periods. A nonselection voltage for bringing a TFD into a nonconductive state for the first half period and a selection voltage for bringing the TFD into a conductive state for the second half period are supplied as a scanning signal to the scanning line. When an odd scanning line is selected, a right shift modulation method is applied to the pixels located on the relevant scanning line; when an even scanning line is selected, a left shift modulation method is applied to the pixels located on the relevant scanning line. Thus a data signal Xi is supplied to the relevant data line. Since only one voltage switching of the data signal Xi per one horizontal scanning period is required for white or black display, and since only two voltage switchings are required for halftone display, the power consumption required for voltage switching is reduce.

10 Claims, 17 Drawing Sheets

SYSTEMS AND METHODS FOR DRIVING A DISPLAY DEVICE

BACKGROUND OF THE INVENTION

1. Field of Invention

The present invention relates to a method of driving a display device such that a gray-scale image is displayed by means of pulse width modulation with reduced electrical power consumption. The present invention also relates to a driver circuit based on such a method, a display device, and an electronic device.

2. Description of Related Art

In general, a portable electronic device includes a display device for presenting various kinds of information to a user. In display devices for such a purpose, information is displayed using an electrooptical change in an electrooptical material. For example, liquid crystal display devices are widely used for this purpose. In recent years, it has become desirable that display devices be capable not just of providing a simple on/off (two value) display but also of representing a large number of gray levels to display a gray-scale image.

However, in portable electronic devices which are driven by a battery, it is very important that the portable electronic devices operate with small power consumption. As is well known, a relatively greater power consumption is required to display a gray-scale image than is needed to provide a simple on/off display. That is, in display devices for use in portable electronic devices, it is necessary to meet both the requirements of having the capability of displaying a gray-scale image and having small power consumption, which seem to conflict with each other.

SUMMARY OF THE INVENTION

In view of the above, it is an object of the present invention to provide a method of driving a display device so as to display a gray-scale image without causing a significant increase in power consumption, a driver circuit for implementing the method and a display device using such a method, and an electronic device using such a display device.

According to a first aspect of the present invention, there is provided a method of driving a display device so as to display a gray-scale image by driving pixels disposed at locations corresponding to respective intersections of a plurality of scanning lines extending along rows and a plurality of data lines extending along columns. The method comprising the steps of sequentially selecting the plurality of scanning lines one by one every horizontal scanning period, and applying a selection voltage to a selected scanning line during one of two half periods that the horizontal scanning period has been divided into and applying a voltage to a pixel such that, in the case in which, of the plurality of scanning lines, a scanning line in either an odd-numbered or an even-numbered row is selected, a turn-on or a turn-off voltage is applied to a pixel at a location corresponding to an intersection of the selected scanning line and a data line belonging to a first group such that in one of the two half periods of each horizontal scanning period. The turn-on voltage is applied via the data line to the pixel during a period from the start of one of the two half periods of the horizontal scanning period until a time corresponding to a gray level has elapsed, and the turn-off voltage is applied to the pixel during the remaining period of said one of the two half periods. While in the case in which, of the plurality of scanning lines, a scanning line in the other one of odd-numbered and even-numbered rows is selected, the turn-on or the turn-off voltage is applied to the pixel at the location corresponding to the intersection of said scanning line and the data line belonging to the first group such that the turn-on voltage is applied via the data line to the pixel during a period from a point of time earlier than the end of the one of the two half periods of the horizontal scanning period by an amount of length of time corresponding to a gray level until the end of the one of the two half period, and the turn-off voltage is applied to the pixel during the remaining period of the one of the two half periods, and in either of these cases, in the other of said two half periods of the horizontal scanning period, the turn-on voltage is applied during a period equal to the period in which the turn-off voltage is applied in the one of the two half periods, while the turn-off voltage is applied during a period equal to the period in which the turn-on voltage is applied in the one of the two half periods.

In this first aspect of the present invention, for a pixel at a location corresponding to an intersection of a scanning line located in either an odd-numbered row or an even-numbered row and a data line belonging to the first group, a gray level is displayed using of left-side modulation. On the other hand, for a pixel at a location corresponding to an intersection of a scanning line located in the other one of the odd-numbered and even-numbered rows and a data line belonging to the first group, a gray level is displayed using of right-side modulation. This allows a reduction in the number of times the voltage applied to a data line is switched between the turn-on voltage and the turn-off voltage, and thus it is possible to reduce electric power consumed in switching the voltage.

In this first aspect of the present invention, if the plurality of data lines all belong to the first group, it is possible to achieve a simplified configuration because it is not necessary to distinguish data lines.

Furthermore, in the first aspect of the present invention, applying of voltage to a pixel may be performed such that in the case in which a scanning line in either an odd-numbered or an even-numbered row is selected, the turn-on or the turn-off voltage is applied to a pixel at a location corresponding to the intersection of the scanning line and a data line not belonging to the first group such that in one of the two half periods of each horizontal scanning period, the turn-on voltage is applied via the data line to the pixel during a period from a point of time earlier than the end of the one of the two half periods of the horizontal scanning period by an amount of length of time corresponding to a gray level until the end of the one of the two half periods, and the turn-off voltage is applied to the pixel during the remaining period of the one of the two half periods. While, in the case in which a scanning line in the other one of odd-numbered and even-numbered rows is selected, the turn-on or the turn-off voltage is applied to the pixel at the location corresponding to the intersection of the scanning line and the data line not belonging to the first group such that the turn-on voltage is applied via the data line to the pixel during a period from the start of one of the two half periods of the horizontal scanning period until a time corresponding to a gray level has elapsed, and the turn-off voltage is applied to the pixel during the remaining period of the one of the two half periods In either of these cases, in the other of the two half periods of the horizontal scanning period, the turn-on voltage is applied during a period equal to the period in which the turn-off voltage is applied in the one of the two half periods, while the turn-off voltage is applied during a period equal to the period in which the turn-on voltage is applied in the one of the two half periods. In this method, when a certain scanning line is selected, the timing of applying the turn-on voltage to a data line belonging to the first group and the timing of applying the turn-on voltage to a data line not belonging to the first group becomes different even for the same gray level. This allows a reduction in the number of data lines whose voltage is changed at the same time when the same gray level is displayed at a plurality of pixels. As a result, it becomes possible to suppress degradation in the selection voltage applied to a scanning line into a dull waveform, and thus it becomes possible to suppress degradation in image quality.

For the above reason, it is desirable that the number of data lines belonging to the first group be equal to or nearly equal to the number of data lines not belonging to the first group. In this case, even when the same intermediate gray level is displayed on all pixels at locations corresponding to a selected scanning line, the turn-on voltage supplied to data lines is switched only twice. Besides, the number of data lines which are switched at the same time becomes one-half the total number of data lines. More specifically, the data lines belonging to the first group may be those data lines, of the plurality of data lines, located in either odd-numbered columns or even-numbered columns.

According to a second aspect of the present invention, there is provided a driver circuit for driving a display device so as to display a gray-scale image by driving pixels disposed at locations corresponding to respective intersections of a plurality of scanning lines extending along rows and a plurality of data lines extending along columns. The driver circuit including a scanning line driver circuit for sequentially selecting the plurality of scanning lines one by one every horizontal scanning period, and applying a selection voltage to a selected scanning line during one of two half periods that the horizontal scanning period has been divided into and a data line driver circuit for applying a voltage to a pixel such that, in the case in which, of said plurality of scanning lines, a scanning line in either an odd-numbered or an even-numbered row is selected, a turn-on or a turn-off voltage is applied to a pixel at a location corresponding to an intersection of the scanning line and a data line belonging to a first group. The voltage is applied, such that in one of the two half periods of each horizontal scanning period, the turn-on voltage is applied via the data line to the pixel during a period from the start of one of the two half periods of the horizontal scanning period until a time corresponding to a gray level has elapsed, and the turn-off voltage is applied to the pixel during the remaining period of the one of the two half periods. While, in the case in which, of the plurality of scanning lines, a scanning line in the other one of odd-numbered and even-numbered rows is selected, the turn-on or the turn-off voltage is applied to the pixel at the location corresponding to the intersection of the scanning line and the data line belonging to the first group such that the turn-on voltage is applied via the data line to the pixel during a period from a point of time earlier than the end of the one of the two half periods of the horizontal scanning period by an amount of length of time corresponding to a gray level until the end of the one of the two half period, and the turn-off voltage is applied to the pixel during the remaining period of the one of the two half periods, and in either of these cases, in the other of said two half periods of the horizontal scanning period. The turn-on voltage is applied during a period equal to the period in which the turn-off voltage is applied in the one of the two half periods, while the turn-off voltage is applied during a period equal to the period in which the turn-on voltage is applied in the one of the two half periods. According to this second aspect of the present invention, as with the first aspect of the present invention, a reduction is achieved in the number of times the voltage applied to a data line is switched between the turn-on voltage and the turn-off voltage, and thus it is possible to reduce electric power consumed in switching the voltage.

According to a third aspect of the present invention, to achieve the above-described object, there is provided a display device having a pair of substrates, an electrooptical material disposed between the pair of substrates, and a plurality of scanning lines formed on one of the pair of substrates, a plurality of data lines formed on the other one of the pair of substrates. Pixels are disposed at locations corresponding to intersections of the plurality of scanning lines and the plurality of data lines. The display device serving to display a gray-scale image by driving the pixels. The display device further includes a scanning line driver circuit for sequentially selecting the plurality of scanning lines one by one every horizontal scanning period, and applying a selection voltage to a selected scanning line during one of two half periods that the horizontal scanning period has been divided into. The display device also includes a data line driving circuit for applying a voltage to a pixel such that in the case in which, of the plurality of scanning lines, a scanning line in either an odd-numbered or an even-numbered row is selected, a turn-on or a turn-off voltage is applied to a pixel at a location corresponding to an intersection of the scanning line and a data line belonging to a first group such that in one of the two half periods of each horizontal scanning period. The turn-on voltage is applied via the data line to the pixel during a period from the start of one of the two half periods of the horizontal scanning period until a time corresponding to a gray level has elapsed, and the turn-off voltage is applied to the pixel during the remaining period of the one of the two half periods. While, in the case in which, of the plurality of scanning lines, a scanning line in the other one of odd-numbered and even-numbered rows is selected, the turn-on or the turn-off voltage is applied to the pixel at the location corresponding to the intersection of the scanning line and the data line belonging to the first group such that the turn-on voltage is applied via the data line to the pixel during a period from a point of time earlier than the end of the one of the two half periods of the horizontal scanning period by an amount of length of time corresponding to a gray level until the end of the one of the two half periods. The turn-off voltage is applied to the pixel during the remaining period of the one of the two half periods, and in either of these cases, in the other of the two half periods of the horizontal scanning period, the turn-on voltage is applied during a period equal to the period in which the turn-off voltage is applied in the one of the two half periods, while the turn-off voltage is applied during a period equal to the period in which the turn-on voltage is applied in the one of the two half periods. According to this third aspect of the present invention, as with the second or the second aspect of the present invention, a reduction is achieved in the number of times the voltage applied to a data line is switched between the turn-on voltage and the turn-off voltage, and thus it is possible to reduce electric power consumed in switching the voltage.

In this third aspect of the present invention, preferably, the pixel includes a switching element and a capacitor formed of the electrooptical material, and the capacitor is driven by the switching element. In this construction, a selected pixel and a non-selected pixel is electrically isolated from each other by the switching element, and thus good contrast and response can be obtained and a high-quality image can be displayed.

In this construction, a thin film diode having a conductor/insulation/conductor structure may be preferably used as the switching element. In this case, one end of the thin film diode is connected to either a scanning line or a data line, and the other end thereof is connected to the capacitor. When the thin film diode is used as the switching element, the production process becomes simpler. Besides, principally, no short-circuited path is created between a scanning line and a data line.

According to a fourth aspect of the present invention, there is provided an electronic device including a display device according to the previous aspect of the invention. The electronic device according to the present invention is capable of displaying a gray-scale image with reduced power consumption.

BRIEF DESCRIPTION OF THE DRAWINGS

The preferred embodiments of this invention will be described, with reference to the following Figures, wherein.

DETAILED DESCRIPTION OF PREFERRED EMBODIMENTS

Embodiments of the present invention are described below with reference to the accompanying drawings.

Figure 1:
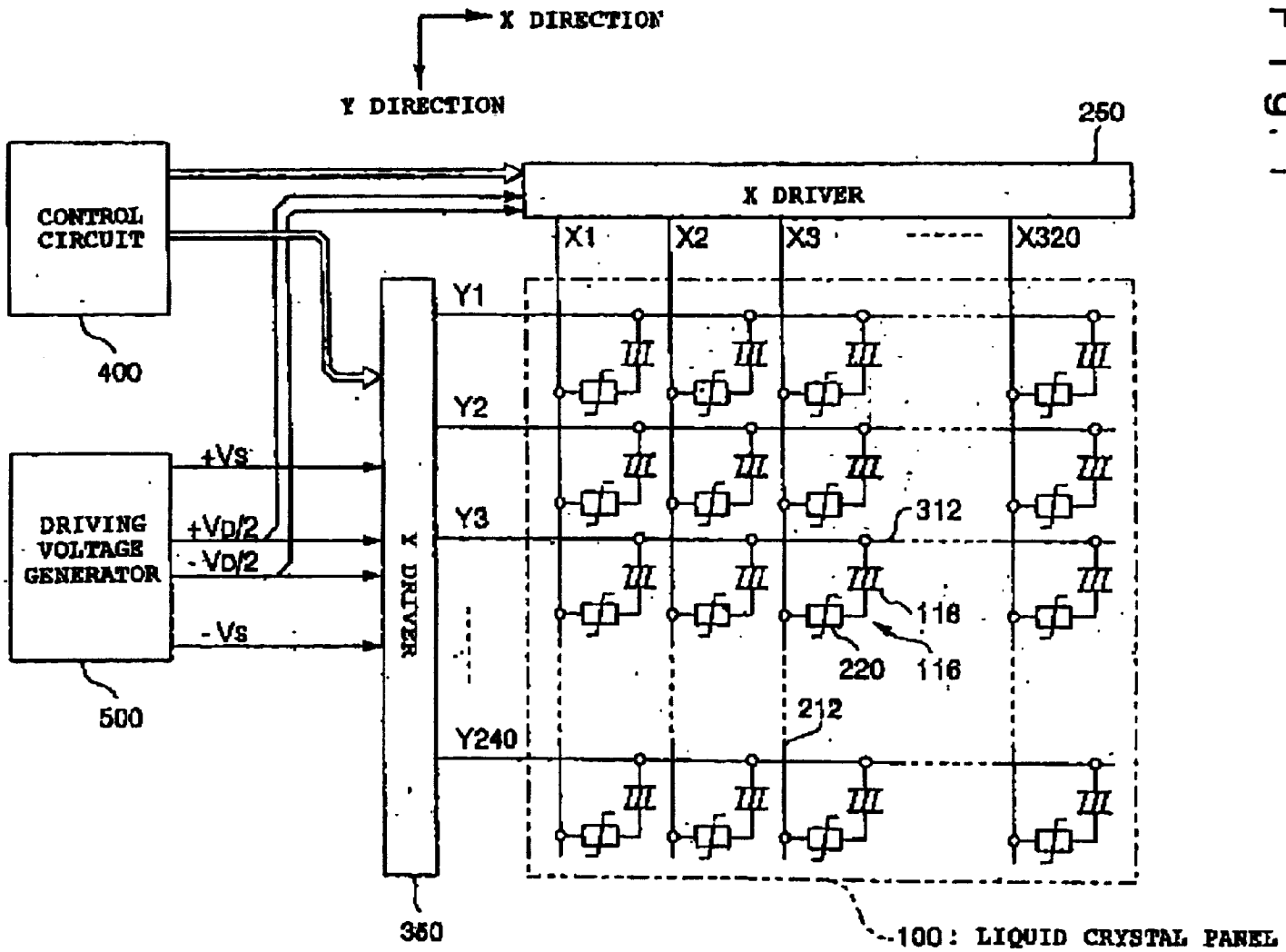
FIG. 1 is an exemplary block diagram illustrating the electrical configuration of a display device according to an embodiment of the present invention.

The electrical configuration of a display device according to an embodiment of the present invention is described below. FIG. 1 is an exemplary block diagram illustrating the electrical configuration of the display. In a liquid crystal panel 100, as shown in FIG. 1, data lines (segment electrodes) 212 are formed so as to extend along columns (in a Y direction), and scanning lines (common electrodes) 312 are formed so as to extend along rows (in an X direction). In the present embodiment, by way of example but not of limitation, there are a total of 240 scanning lines 312 and a total of 320 data lines 212, and the display device is formed so as to serve as a 240×320 matrix display device. Pixels 116 are formed at respective locations corresponding to intersections of the data lines 212 and the scanning lines 312. Each pixel 116 is composed of a series connection of a liquid crystal layer 118 and a TFD (Thin Film Diode) 220 serving as a switching element.

A Y driver 350, which is also called a scanning line driver circuit, serves to supply scanning signal Y1, Y2, . . . , Y240 to corresponding scanning lines 312. More specifically, the scanning lines 312 are selected one by one and a selection voltage is applied to a selected scanning line 312 during a second half of a selection period. A non-selection voltage is applied to each scanning line 312 during a first half of the selection period and also during a non-selection period. An X driver 250, which is also called a data line driver circuit, serves to supply data signals X1, X2, . . . , X320, corresponding to a content to be displayed, to pixels 116 located along a scanning line 312 selected by the Y driver 350, via corresponding data lines 212.

A control circuit 400 supplies various control signals and a clock signal to the X driver 250 and the Y driver 350 to control them. A driving voltage generator 500 generates voltages of ±VD/2 and ±VS, wherein voltages of ±VD/2 are used as data voltages of a data signal and also as non-selection voltages of a scanning signal, and voltages of ±VS are used as selection voltages of a scanning signal.

In the present embodiment, the polarities of voltages applied to the scanning lines 312 and the data lines 212 are defined such that the middle potentials of the data voltages ±VD/2 applied to the data lines 212 is employed as a reference voltage and potentials higher than the reference voltage are regarded as positive and those lower than the reference voltage as negative.

Figure 2:
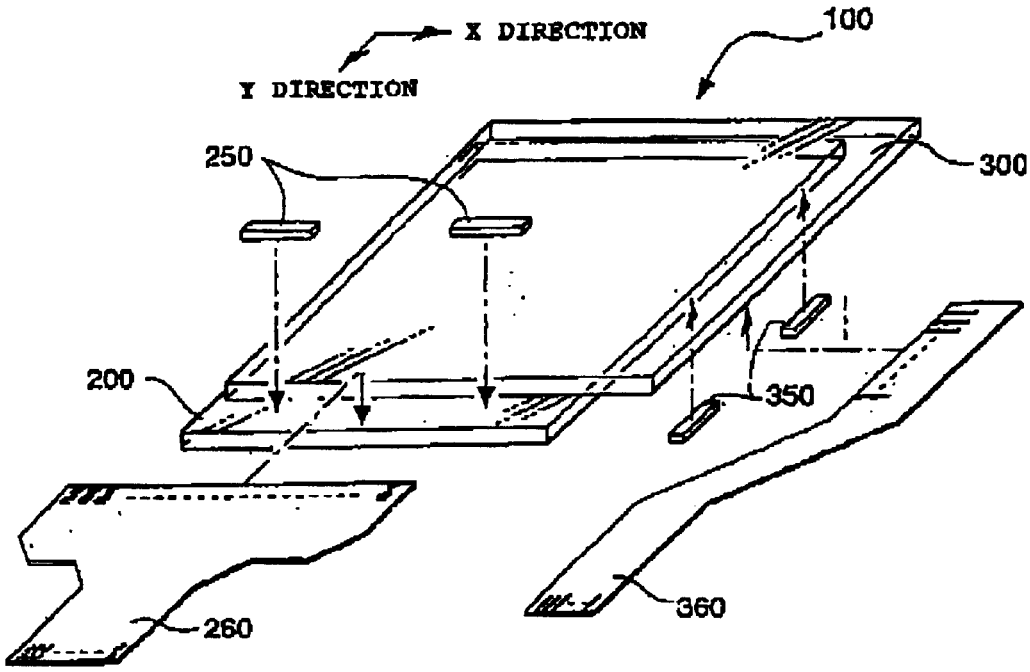
FIG. 2 is a perspective view illustrating the structure of a liquid crystal panel of the display device.

The mechanical structure of the display device according to the present embodiment is described below. FIG. 2 is a perspective view generally illustrating the structure of the display device. As shown in FIG. 2, the liquid crystal panel 100 includes a device substrate 200 and an opposite substrate 300 which are adhesively connected to each other. The device substrate 200 has a part extending outward beyond an edge of the opposite substrate 300, wherein the upper surface of this extending part serves as a terminal area. In this terminal area, the X driver 250 in the form of a bare chip can be mounted by means of a COG (Chip On Glass) technique. Furthermore, one end of an FPC (Flexible Printed Circuit) board 260 is connected to the terminal area of the device substrate 200 so as to supply various signals to the X driver 250. Similarly, the opposite substrate 300 has a part extending outward beyond an edge of the device substrate 200 wherein the lower surface of this extending part serves as a terminal area. In this terminal area of the opposite substrate 300, the Y driver 350 in the form of a bare chip can be mounted by means of a COG technique, and one end of an FPC board 360 is connected to the terminal area of the device substrate 300 so as to supply various signals to the Y driver 350. The other ends of the FPC substrates 260 and 360 are respectively connected to the control circuit 400 and the driving voltage generator 500 (FIG. 1).

The X driver 250 and the Y driver 350 can be mounted as follows. First, they are placed at predetermined locations on the corresponding substrate such that anisotropic conductive films formed by uniformly dispersing conductive microparticles into an adhesive material are placed between the respective chips and the substrates. The bare chips of the X and Y drivers are pressed against the respective substrate while heating them. Connecting of the FPC substrates 260 and 360 is also performed in a similar manner. Instead of mounting the X driver 250 and the Y driver 350 on the device substrate 200 and the opposite substrate 300, respectively, they may be mounted on a TCP (Tape Carrier Package) and connected using a TAB (Tape Automated Bonding) technique such that electrical and mechanical connections of the X driver 250 and the Y driver 350 are achieved via an anisotropic conductive film disposed at a particular location on a substrate.

Figure 3:
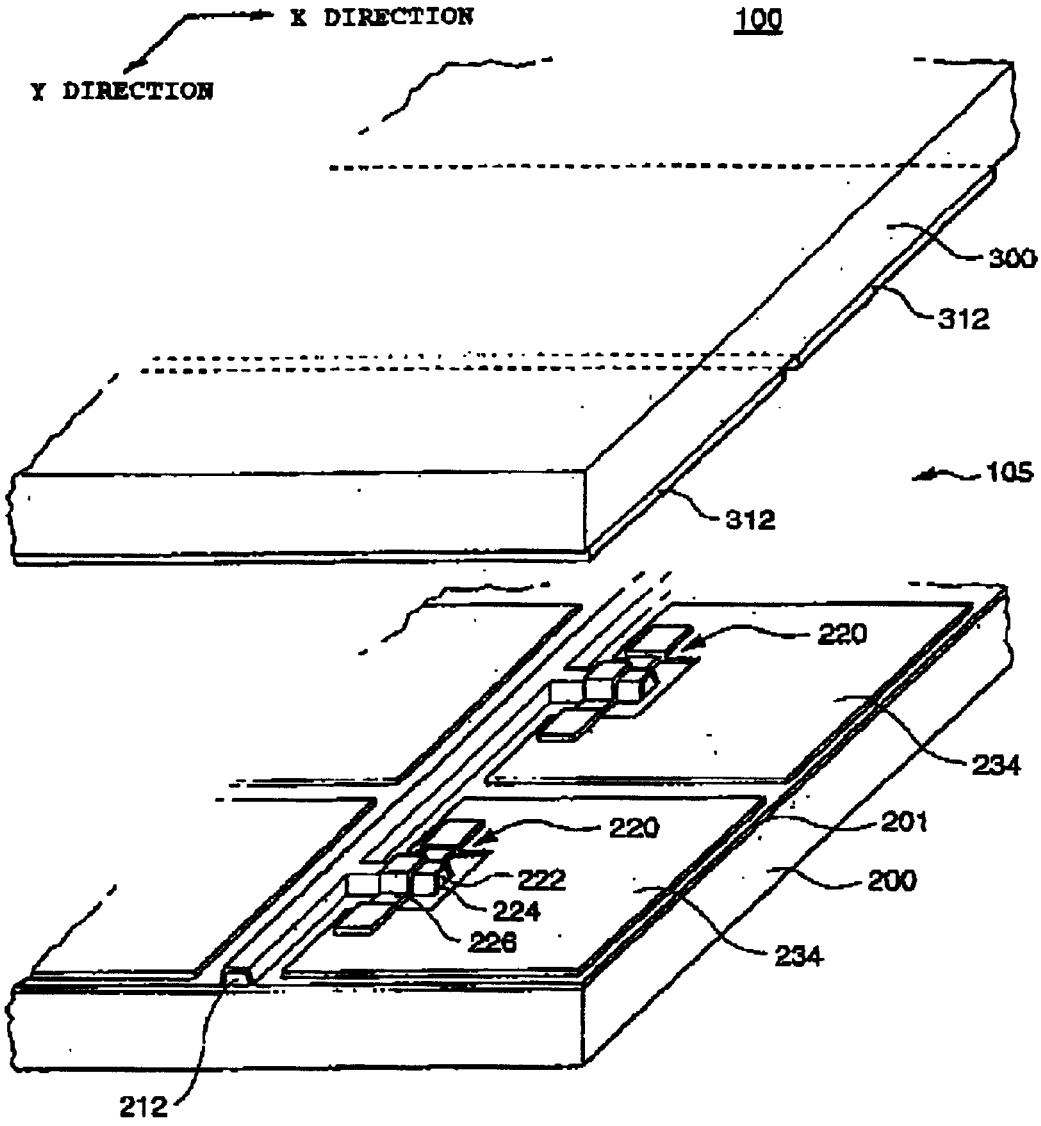
FIG. 3 is a fragmentary perspective view illustrating the structure of a main part of the liquid crystal panel.

The detailed structure of pixels 116 of the liquid crystal panel 100 is described below. FIG. 3 is a fragmentary perspective view illustrating some pixels. As shown in FIG. 3, pixel electrodes 234 formed of a transparent conducting material such as ITO (Indium Tin Oxide) are disposed in the form of a matrix on the surface, facing the opposite substrate, of the device substrate 200. Of these pixel electrodes 234, 240 pixel electrodes 234 arranged in the same single column are connected via corresponding TFDs 220 to one of data lines 212 extending in a Y direction. Each TFD 220 is formed so as to have a sandwich structure of conductor/insulator/conductor using a first conductor 222 which is formed of tantalum in the form of elementary substance or an tantalum alloy and which extends as a branch from one of the data lines 212, an insulator 224 obtained by anodizing the first conductor 222, and a second conductor 226 such as chromium such that the TFD 220 has a diode switching characteristic having nonlinearity in current-voltage characteristic in both forward and reverse directions.

An insulating film 201, which is transparent and electrically insulating, is formed on the upper surface of the device substrate 200. This insulating film 201 serves to prevent the first conductor 222 from peeling off during a heat treatment performed after deposition of the second conductor 226, and also serves to prevent an impurity from diffusing into the first conductor during the heat treatment. When no problem associated with the peeling off and the diffusion occurs, the insulating film 201 may be eliminated.

On the surface, facing the device substrate, of the opposite substrate 300, scanning lines 312 formed of ITO or the like extend in a row direction perpendicular to the direction in which the data lines 212 extends, wherein the scanning lines 312 are disposed at locations corresponding to the pixel electrodes 234 so that the scanning lines 312 serve as opposite electrodes opposing the pixel electrodes 234.

The device substrate 200 and the opposite substrate 300 are spaced a predetermined distance from each other by a sealing material (not shown) coated on the substrates in a peripheral region and also by spacers (not shown) properly distributed. A liquid crystal 105 of, for example, the TN (Twisted Nematic) type is disposed and sealed in a closed space between the device substrate 200 and the opposite substrate 300. Thus, each liquid crystal layer 118 shown in FIG. 1 at a location where a data line 212 and a scanning line 312 cross each other is formed of the scanning line 312, a pixel electrode 234, and a corresponding part of the liquid crystal 105 disposed between the scanning line 312 and the pixel electrode 234.

Furthermore, although not shown in the figure, depending upon an application in which the liquid crystal panel 100 is used, color filters can be disposed in the form of stripes, a mosaic, or triangles on the opposite substrate 300. The other areas are covered with a black matrix for blocking light. Furthermore, alignment films rubbed in particular directions are disposed on the mutually-facing surfaces of the device substrate 200 and the opposite substrate 300, respectively, and polarizers or the like corresponding to the alignment directions are disposed on the back faces of the respective substrates.

In the liquid crystal panel 100 constructed in the above-described manner, one pixel 116 can be represented by an equivalent circuit such as that shown in FIG. 1A. In FIG. 1A, one pixel 116 is represented by a series circuit of a TFD 220 and a liquid crystal layer 118, wherein the TFD 220 is represented by a parallel circuit of a resistor RT and a capacitor CT and the liquid crystal layer 118 is represented by a parallel circuit of a resistor RLC and a capacitor CLC.

A data signal Xi and a scanning signal Yj are applied, by means of a predetermined driving method, to respective two ends of the pixel 116 represented by the above equivalent circuit. Herein, the data signal Xi is assumed to be a data signal applied to a data line 212 of the ith column as counted from the leftmost column in FIG. 1, and the scanning signal Yj is assumed to be a scanning signal applied to a scanning line 312 of the jth row as counted from the top row in FIG. 1.

Figure 12:
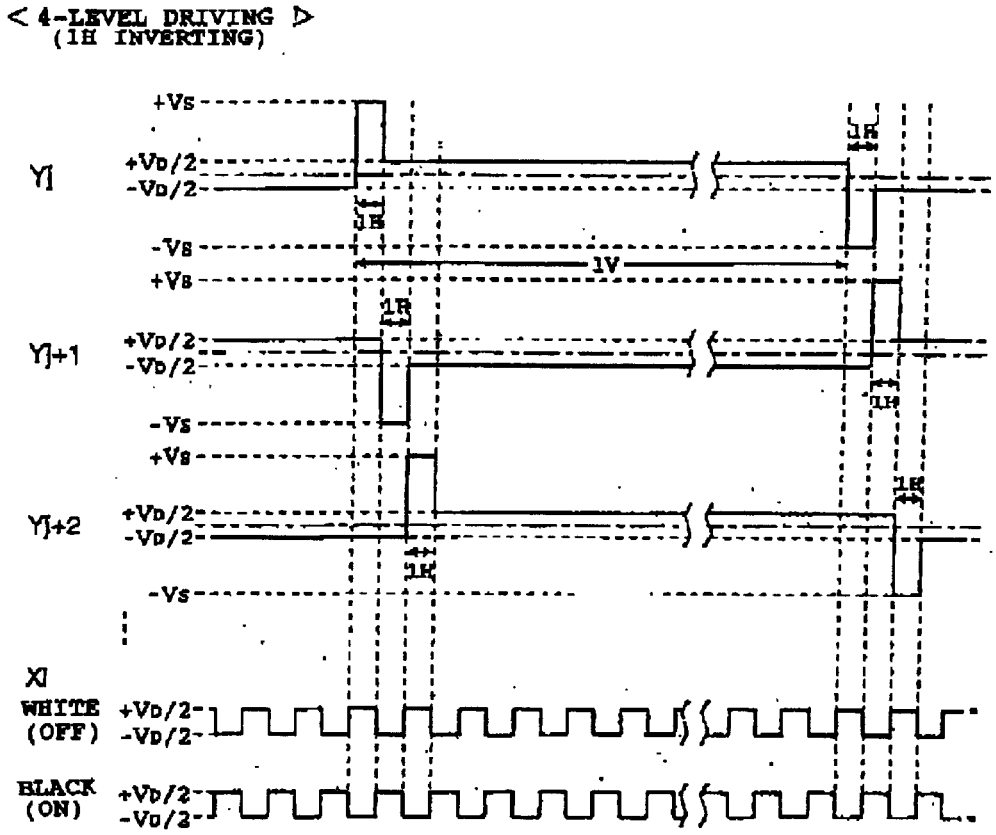
FIG. 12 is a diagram illustrating examples of waveforms of a scanning signal Yj and a data signal Xi according to a 4-value driving (inverting every 1H) method.

A 4-value driving method (inverting every 1H) is widely used as a driving method. FIG. 12 illustrates examples of waveforms of the scanning signal Yj and the data signal Xi which are applied to a certain pixel 116 in accordance with the 4-value driving method. In this driving method, a selection voltage +VS is first applied as the scanning signal Yj during one horizontal scanning period 1H, and then, during a following retention period, a non-selection voltage +VD/2 is applied. If one vertical scanning period (one frame period) 1V has elapsed since the previous selection, a selection voltage −VS is applied. In a following retention period, a non-selection voltage −VD/2 is applied. While performing the above operation repeatedly, either a data voltage +VD/2 or −VD/2 is applied as the data signal Xi. If a selection voltage +VS is applied as the scanning signal Yj to a certain scanning line, a selection voltage −VS/2 is applied as the scanning signal Yj+1 to the subsequent scanning line. As described above, the polarity of a selection voltage inverts every horizontal scanning period 1H. In this 4-value driving method (inverting every 1H), in the case where a pixel 116 is turned on when a selection voltage +VS is applied, −VD/2 is applied as the data signal. On the other hand, to turn off the pixel 1116, +VD/2 is applied as the data signal. However, when a selection voltage −VS is applied, +VD/2 is applied to turn on the pixel 116 and −VD/2 is applied to turn off the pixel 116.

Figure 13:
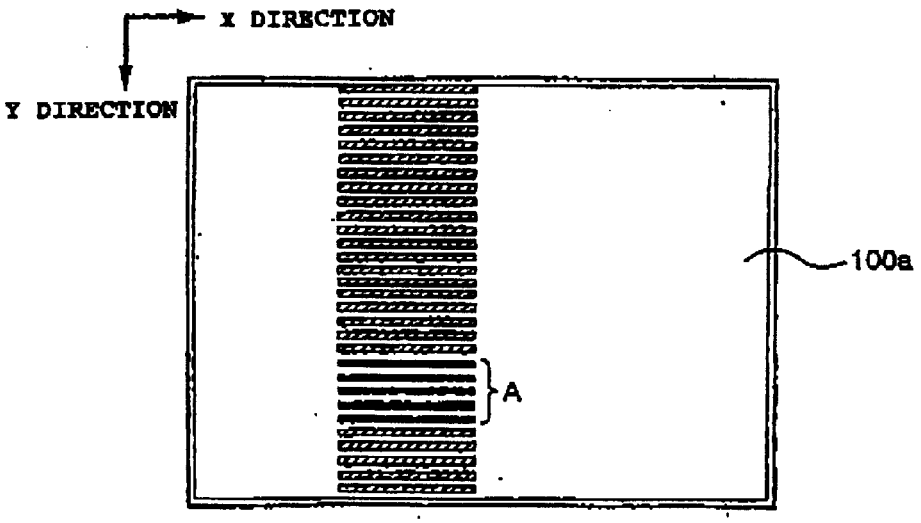
FIG. 13 is a diagram illustrating a problem in a displaying operation.

In this 4-value driving method (inverting every 1H), if a pattern is displayed in a partial area A of a screen 100*a* such that black and white are alternately displayed from one scanning line to next as shown in FIG. 13, crosstalk occurs in this area A in the Y direction.

The reason for the occurrence of crosstalk is briefly described below. When the above pattern is displayed in the area A, the data signals applied to the data line in this area are periodically switched between ±VD/2 at the same intervals as the scanning signals are inverted, and thus the voltages of the data signals are fixed to either +VD/2 or −VD/2 over a period during which selection lines in the area A are selected. When viewed along pixels in the Y direction in the area A, the data voltages are fixed to either +VD/2 or −VD/2 during a particular part of a retention period. On the other hand, as described earlier, the selection voltages applied to adjacent scanning lines are opposite in polarity. Therefore, in areas adjacent to the area A in the Y direction, great differences occur in the effective values of the voltage applied during the part of the retention period between pixels 116 in odd-numbered rows and those in even-numbered rows. As a result, in the areas adjacent to the area A in the Y direction, differences occur in the gray levels between the pixels 116 in odd-numbered rows and those in even-numbered rows, and thus crosstalk occurs.

Figure 14:
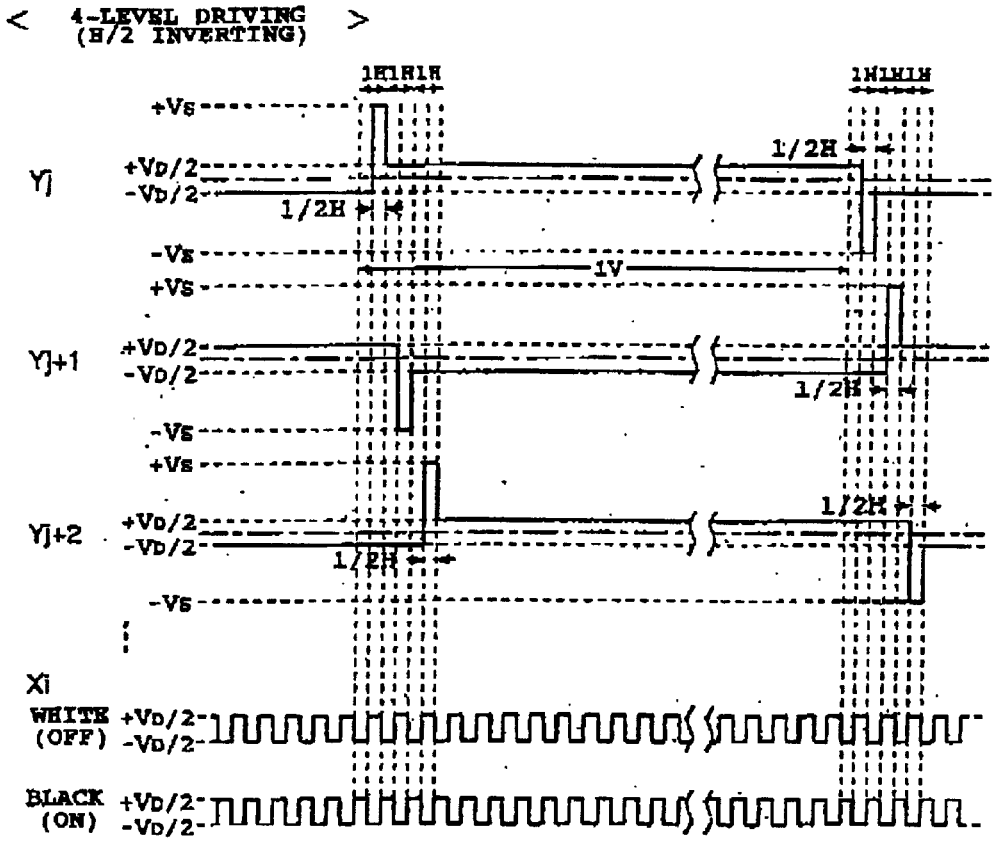
FIG. 14 is a diagram illustrating examples of waveforms of a scanning signal Yj and a data signal Xi according to a 4-value driving (inverting every ½H) method.

One technique of preventing the above problem is to employ a 4-value driving (inverting every ½H) method. In the 4-value driving (inverting every ½H) method, as shown in FIG. 14, each horizontal scanning period 1H in the 4-level driving (inverting every 1H) method is divided into a first and second half periods. A scanning line is selected during each first half period (½H), and data voltages −VD/2 and +VD/2 are respectively applied during periods of 50% of the one total horizontal scanning period 1H. According to the 4-value driving (inverting every ½H) method, even when any pattern is displayed, the data signal Xi has a voltage equal to −VD/2 during a half period of a horizontal scanning period and has a voltage equal to +VD/2 during the other half period, and thus no crosstalk occurs.

Figure 15:
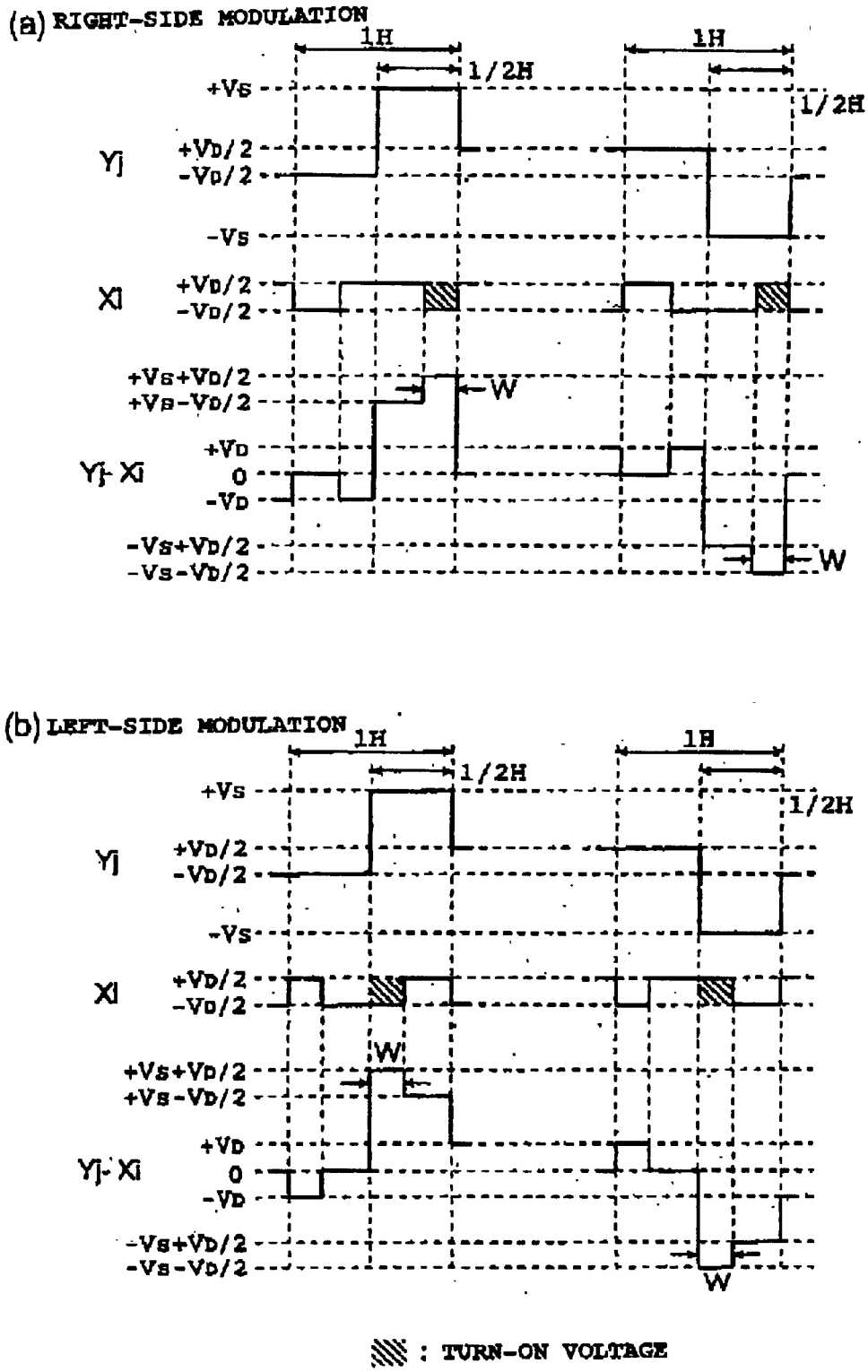
FIG. 15(*a*) is a diagram illustrating a right-side modulation method, and FIG. 15(*b*) is a diagram illustrating a left-side modulation method.

A driving method for obtaining a gray-scale image is described below. Two known methods of displaying a gray-scale image are voltage modulation and pulse width modulation. In the voltage modulation, controlling a voltage so as to obtain a desired gray level is difficult. For this reason, the pulse width modulation is more widely used. The pulse width modulation may be applied to the 4-value driving (inverting every ½H) method in three different manners. In a first manner called right-side modulation, a turn-on voltage can be applied during a period immediately before the end of a selection period as shown in FIG. 15(*a*). In a second manner called left-side modulation, a turn-on voltage is applied during a period at the start of a selection period as shown in FIG. 15(*b*).

In a third manner called distributed modulation (not shown), turn-on voltages with time widths corresponding to weights of respective bits of gray-level data are distributed during a selection period. Herein, the turn-on voltage refers to a data voltage applied to the data lines 212 to write data into the pixels 116, wherein the turn-on voltage has an opposite polarity to that of a selection voltage $\pm V_s$ during a period in which the selection voltage is applied.

Of the three modulation methods, the left-side modulation and the distributed modulation have the drawback that discharging occurs after a turn-on voltage is written, and thus it is difficult to obtain precise gray levels. Further, a high driving voltage is needed in these methods. For the above reason, when a gray-scale image is displayed using the 4-level driving method, the right-side modulation is usually employed.

Figure 11:
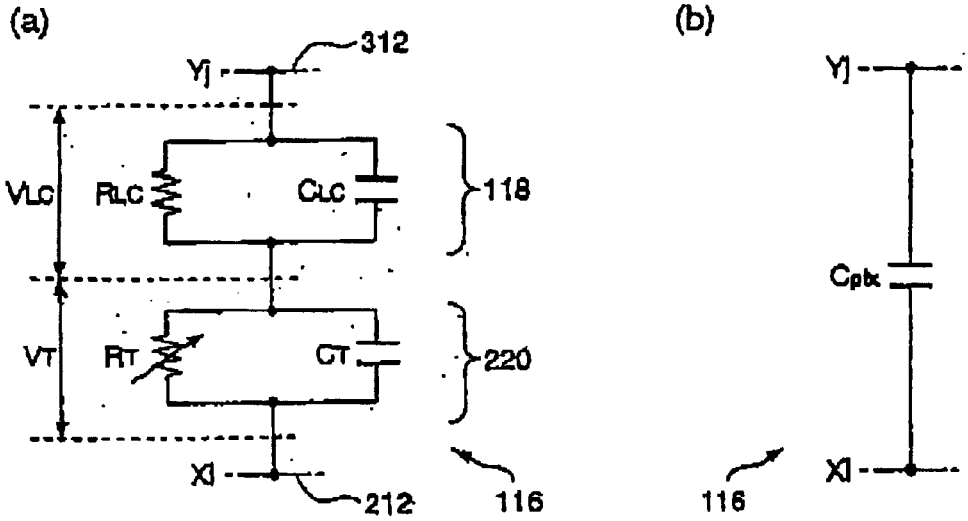
FIGS. 11(*a*) and 11(*b*) are equivalent circuit diagrams of pixels of the respective display devices according to the embodiment and modified embodiment.

In the display device shown in FIG. 1, because there are a total of 240 scanning lines 312, a retention period (non-selection period) in one vertical scanning period 1V is equal to 239 times one horizontal scanning period -1H, that is, 239H. In each retention period, the TFD 220 is turned off, and thus the resistance RT of the TFD 220 becomes very large. On the other hand, the resistance RLC of the liquid crystal layer 118 is very large regardless of whether TFD 220 is in an on-state or off-state. Therefore, in the retention period, the equivalent circuit of the pixel 116 can be represented by a capacitor Cpix equivalent to a series of capacitors CT and CLC as shown in FIG. 11(*b*). Herein, the capacitance Cpix is equal to CT·CLC)/(CT+CLC).

Figure 16:
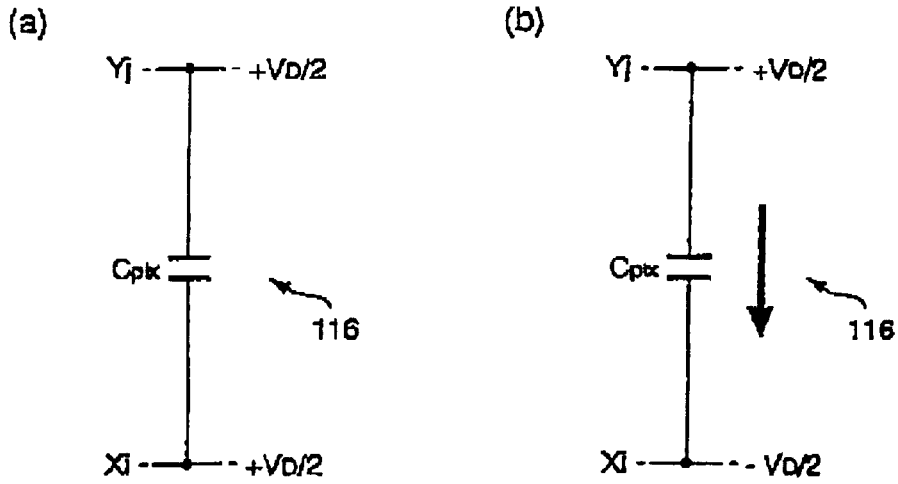
FIGS. 16(*a*) and 16(*b*) are diagrams illustrating switching of the voltage of a data signal Xi in a retention period.

When a certain scanning line 312 is in a non-selected state and a non-selection signal having a voltage of +VD/2 is applied as the scanning signal Yj to that scanning line 312, the data voltage of the data signal Xi is alternately switched to +VD/2 or −VD/2, as shown in FIG. 16(*a*) or 16(*b*). Although not shown in the figure, when a non-selection voltage having a voltage of −VD/2 is applied as the scanning signal Yj to that scanning line, the data voltage of the data signal Xi is also switched alternately to +VD/2 or −VD/2. Therefore, in one pixel 116, even in a retention period, a charge equal to Cpix·VD is supplied from a power supply when the voltage of the data signal Xi is switched twice, and thus power is consumed by a capacitive load of the pixel 116.

Figure 17:
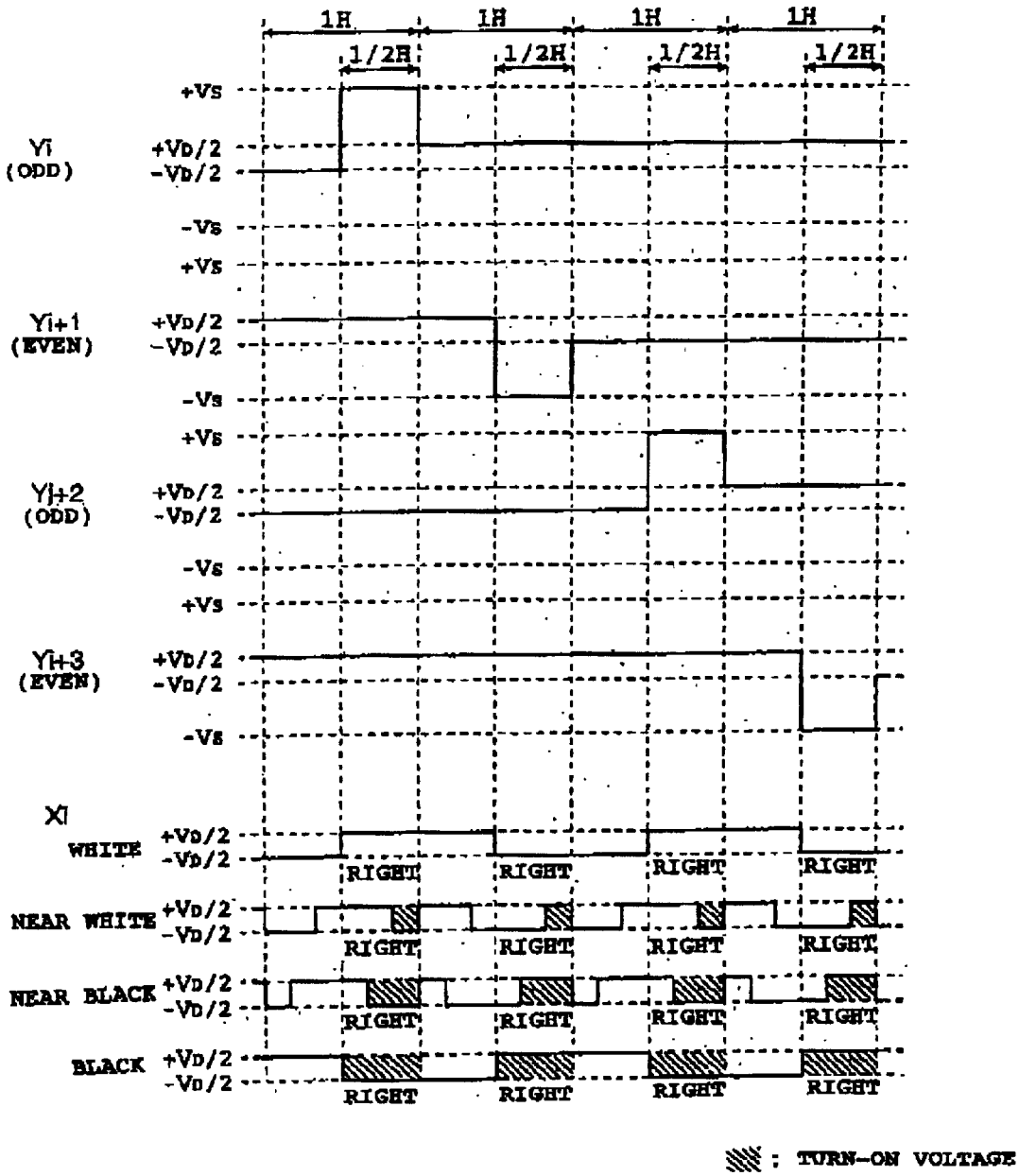
FIG. 17 is a diagram illustrating examples of waveforms of a scanning signal Yj and a data signal Xi according to the right-side modulation method.

In the case where the right-side modulation is used to display a gray-scale image using the 4-value driving method, when pixels 116 in a certain column are displayed as white (off) or black (on), the voltage of the data signal Xi for this column is switched once during one horizontal period 1H as shown in FIG. 17. However, when pixels 116 in a certain column are at an intermediate gray level (for example, near white or near black), the voltage of the data signal Xi for this column is switched three times during one horizontal period 1H as shown in FIG. 17. Therefore, when a certain pixel 116 is at an intermediate gray level, electric power consumed in the retention period becomes three times greater than that consumed when the pixel 116 is displayed as white or black.

Figure 8:
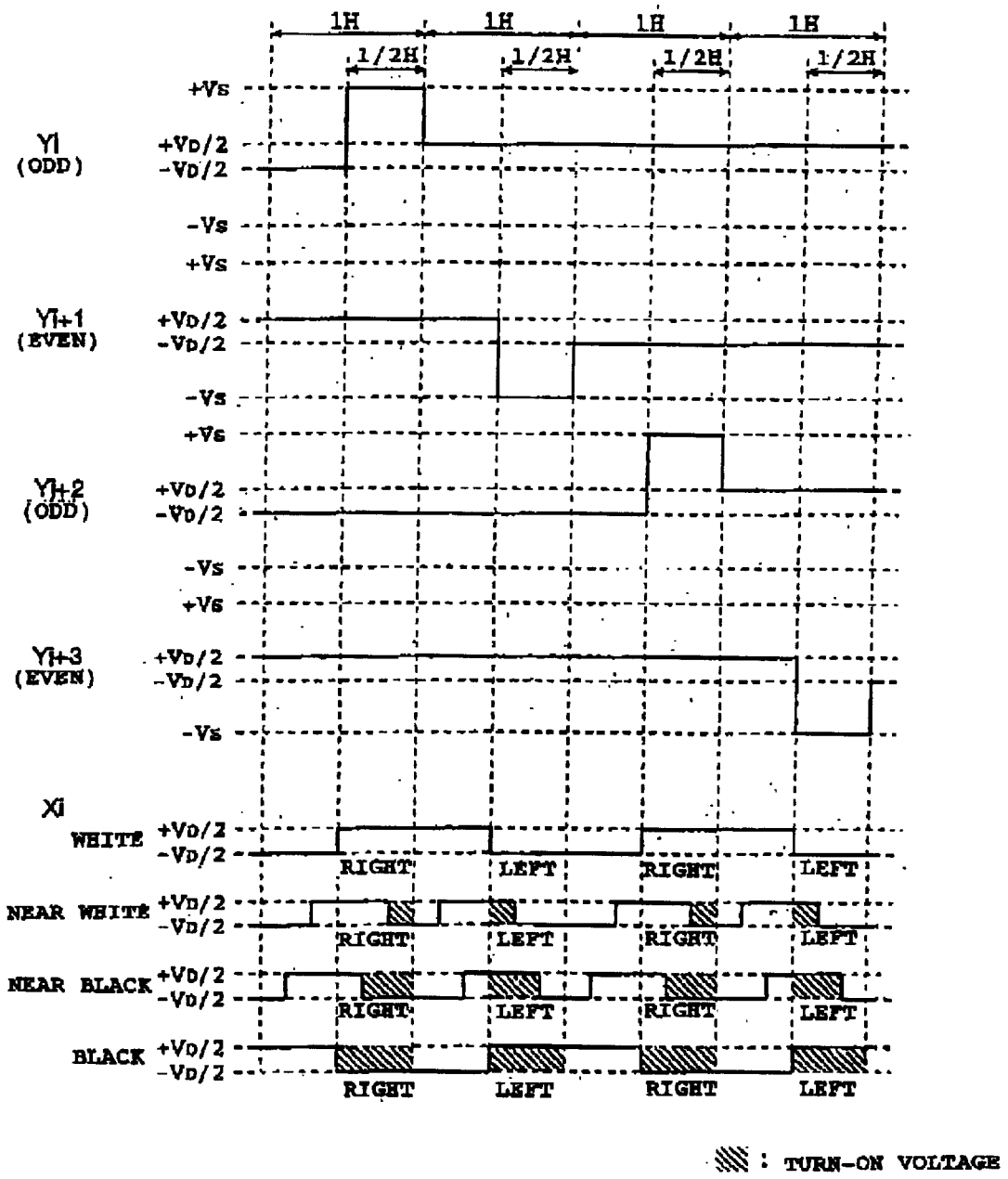
FIG. 8 is a timing chart illustrating waveforms associated with a driving operation of the X driver.

In the display device according to the present embodiment of the invention, to prevent the above problem, as shown in FIG. 8, the right-side modulation is applied to pixels 116 connected to scanning lines 312 in odd-numbered rows, while the left-side modulation is applied to pixels 116 connected to scanning lines 312 in even-numbered rows, thereby reducing, to two, the number of times the voltage of the data signal Xi is switched during one horizontal period 1H when pixels 116 in a certain column are at an intermediate gray level and thus suppressing the power consumed during the retention period. A circuit used to perform such a driving operation is described below.

Figure 5:
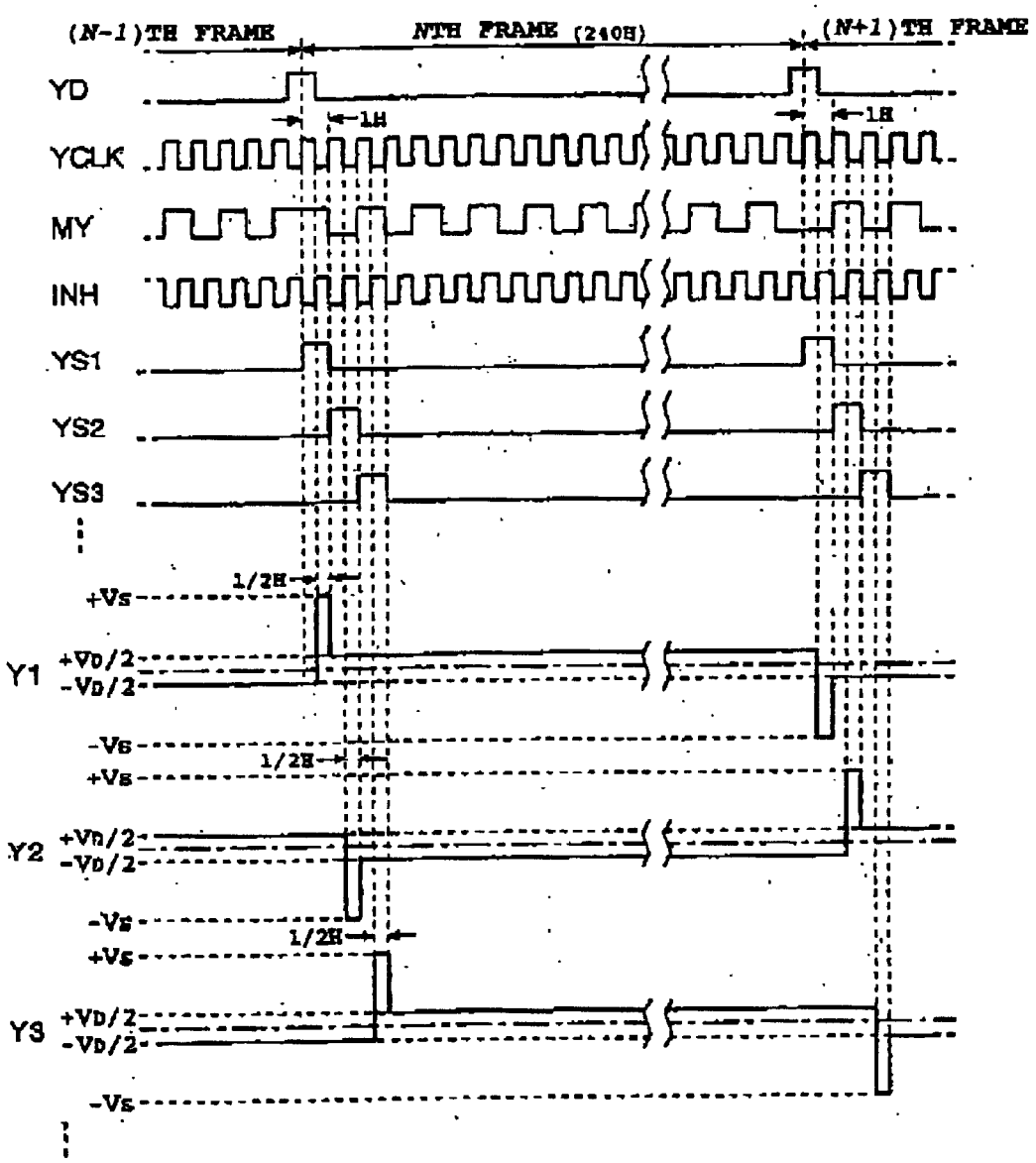
FIG. 5 is a timing chart illustrating an operation of the Y driver.

First, various control signals such a clock signal and other control signals generated by the control circuit 400 are described. A start pulse YD is generated at the beginning of each vertical scanning period (each frame period) as shown in FIG. 5.

A clock signal YCLK is a reference signal associated with the scanning lines. As shown in FIG. 5, the clock signal YCLK has a period equal to one horizontal scanning period 1H. An AC driving signal MY is a signal for controlling the pixels 116 to be driven via the scanning lines in an AC fashion. As shown in FIG. 5, the signal level of the AC driving signal MY is inverted every horizontal scanning period 1H. Furthermore, the signal level associated with the same scanning line is inverted every vertical scanning period. As a result, polarity of the selection voltage is inverted by the AC driving signal MY every horizontal scanning period 1H, and the polarity is also inverted every vertical scanning period. A control signal INH is generated to select a second half period of one horizontal scanning period 1H. As shown in FIG. 5, the control signal INH becomes active (goes to a high level) during the second half period.

Figure 7:
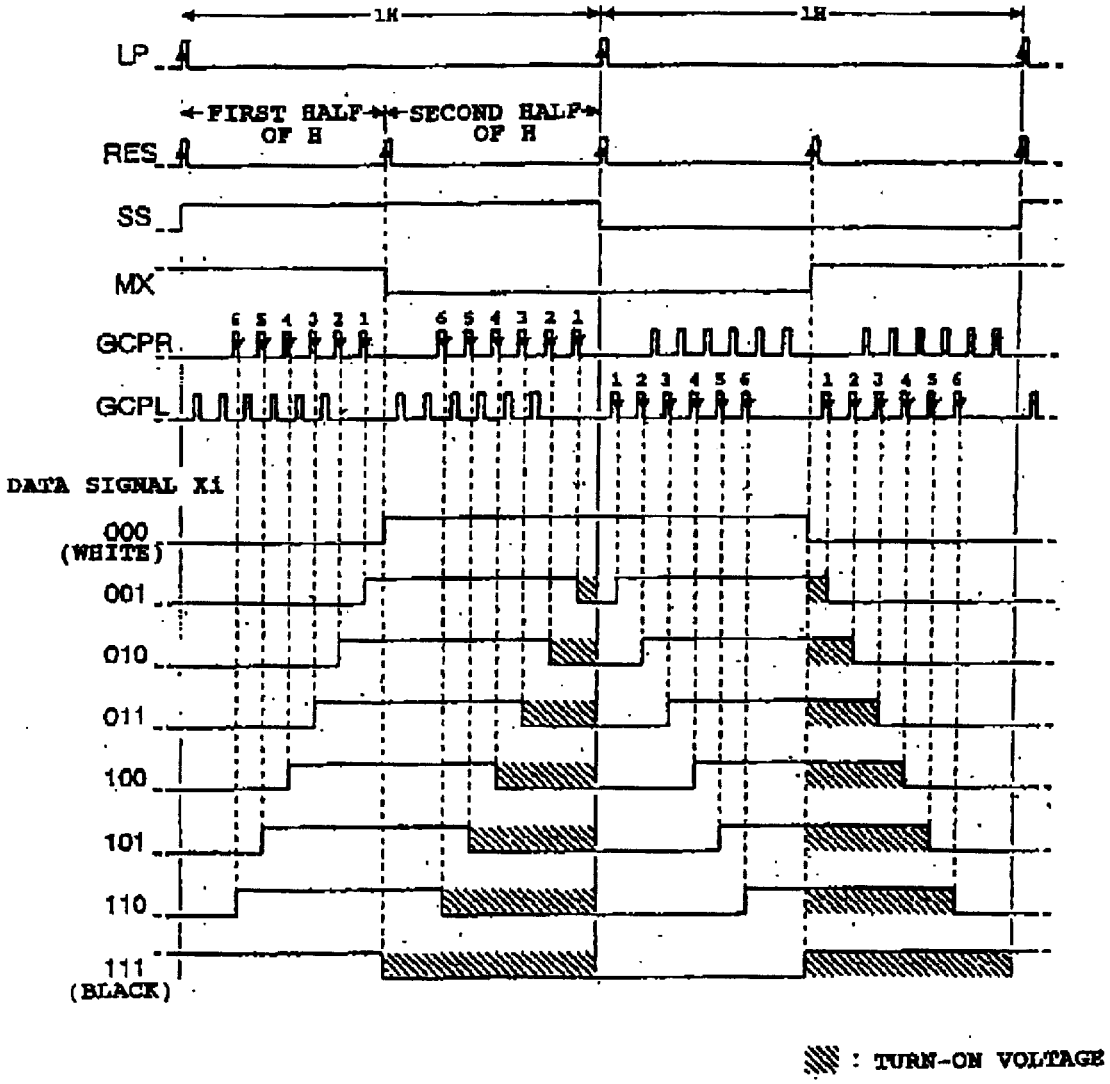
FIG. 7 is a timing chart illustrating an operation of the X driver.

A latch pulse LP is generated to latch a data signal on the data line side. As shown in FIG. 7, a latch pulse LP is generated at the beginning of each horizontal scanning period 1H. A reset signal RES is generated at the beginning of a first half period and at the beginning of a second half period of each horizontal scanning period 1H as shown in FIG. 7. As shown in FIG. 7, an odd/even signal SS becomes high during a horizontal scanning period in the second half of which a scanning line 312 in an odd-numbered row is selected, while the odd/even signal SS becomes low during a horizontal scanning period in the second half of which a scanning line 312 in an even-numbered row is selected. An AC driving signal MX is a signal for controlling the pixels 116 to be driven via the data lines in an AC fashion. As shown in FIG. 7, the AC driving signal MX is maintained at an equal signal level during the second half of each horizontal scanning period 1H and the fist half of the immediately following horizontal scanning period 1H. At the end of the first half of each horizontal scanning period, the signal level is inverted. The AC driving signals MX and MY are opposite in polarity to each other during the second half of each horizontal scanning period.

A right-side gray level code pulse GCPR is a pulse used in the right-side modulation to control the gray level. As shown in FIG. 7, right-side gray level code pulses GCPR are placed immediately before the end of each of the first and second half periods of each horizontal scanning period 1H such that the pulse positions relative to the end of each half period correspond to the gray level. In the present embodiment, if gray level data for specifying the intensity of a pixel is represented by 3 bits so as to indicate one of 8 gray levels, and if (000) indicates white (off) and (111) indicates black (on), six right-side gray level code pulses GCPR that correspond to intermediate gray levels (001) to (110) other than white and black are placed in each of the first and second half periods such that six pulses. More specifically, in FIG. 7, (001), (010), (011), (100), (101), and (110) of gray level data correspond to "1", "2, "3", "4", "5", and "6" of right-side gray level code pulses.

A left-side gray level code pulse GCPL is a pulse used in the left-side modulation to control the gray level. As shown in FIG. 7, left-side gray level code pulses GCPL are placed at particular locations in the first half and the second half of each horizontal scanning period 1H such that the locations with respect to the start of the first half or the second half period correspond to the gray levels. Although in FIG. 7 the right-side gray level code pulses GCPR and the left-side gray level code pulses GCPL are placed at equal intervals for simplicity of illustration, the intervals generally vary depending upon the voltage-intensity (V-I) characteristic of pixels.

Figure 4:
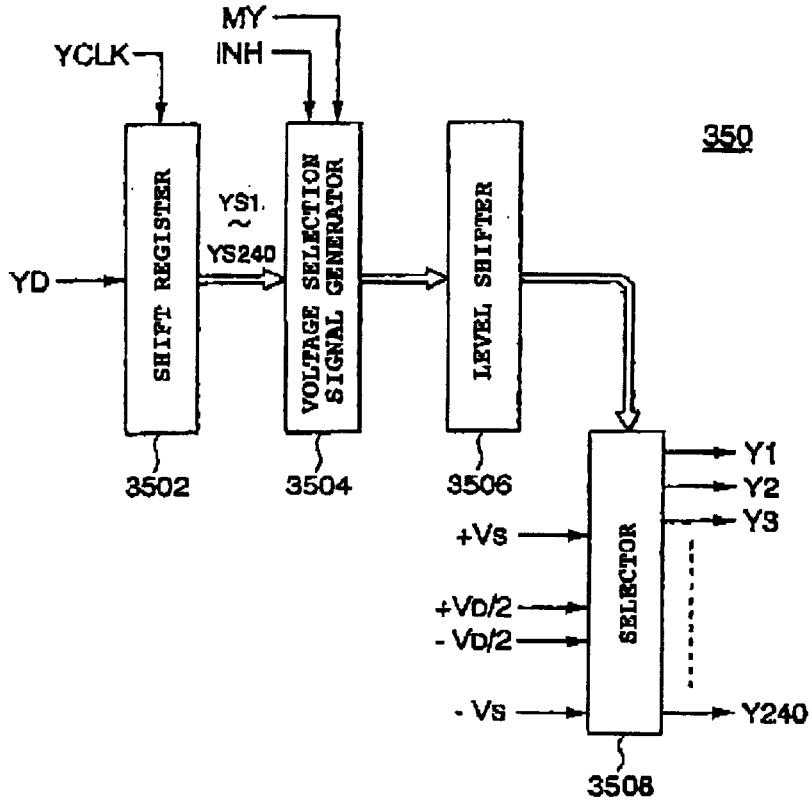
FIG. 4 is an exemplary block diagram illustrating the structure of a Y driver of the display device.

The details of the scanning line driver circuit 350 are now described. FIG. 4 is an exemplary block diagram illustrating the structure of the scanning line driver circuit 350. In FIG. 4, a shift register 3502 is a 240-bit shift register having a register size corresponding to the total number of scanning lines 312. A start pulse YD is supplied to the shift register 3502 at the beginning of each frame. The shift register 3502 shifts the received start pulse YD in response to a clock signal YCLK having the same period as the horizontal scanning period 1H, and outputs transferred signals YS1, YS2, . . . , YS240 such that one signal is output at a time. The transferred signals YS1, YS2, . . . , YS240 correspond in a one-to-one fashion to the respective scanning lines 312 and designate a scanning line 312 to be selected.

A voltage selection signal generator 3504 generates, from the AC driving signal MY and the control signal INH, a voltage selection signal which determines a voltage to be applied to a scanning line 312. In the present embodiment, as described earlier, the voltage of the scanning signal to be applied to a scanning line 312 is equal to one of four values: +VS (positive selection voltage), +VD/2 (positive non-selection voltage), −VS (negative non-selection voltage), and −VD/2 (negative selection voltage). Of these voltages, a selection voltage +VS or −VS is applied during the second half (½H) of a horizontal scanning period. If a selection voltage +VS is applied in the second half of a certain horizontal scanning period, the following non-selection voltage has a level equal to +VD/2. Conversely, when −VS is applied as a selection voltage, the following non-selection voltage has a level equal to −VD/2. In other words, the level of the non-selection voltage is uniquely determined by the previous selection voltage.

To this end, the voltage selection signal generator 3504 generates 240 voltage selection signals such that the voltage levels of the scanning signals Y1, Y2, . . . , Y240 satisfy the following conditions. That is, when one of transferred signals YS1, YS2, . . . , YS240 becomes high, and a corresponding scanning line 312 is selected, the voltage selection signal generator 3504 generates voltage selection signals so that the voltage level of the scanning signal applied to that scanning line 312 becomes equal to a selection voltage corresponding to the AC driving signal MY during a period (second half ½H of a horizontal scanning period) in which the control signal INH is at a high level. In response to a high-to-low transition of the control signal IHN, the voltage level of the scanning signal is changed to a non-selection voltage determined depending upon the previous selection voltage. More specifically, if the AC driving signal MY is high during a period in which the control signal INH is active, the voltage selection signal generator 3504 outputs a voltage selection signal which causes the positive selection voltage +VS to be selected and then outputs a voltage selection signal which causes the positive non-selection voltage +VD/2 to be selected. On the other hand, if the AC driving signal MY is low during a period in which the control signal INH is active, the voltage selection signal generator 3504 outputs a voltage selection signal which causes the negative selection voltage −VS to be selected and then outputs a voltage selection signal which causes the negative non-selection voltage −VD/2 to be selected. The voltage selection signal generator 3504 generates a voltage selection signal in a similar manner for each of 240 signal lines 312.

A level shifter 3506 can expand the amplitude of the voltage of the voltage selection signal output from the voltage selection signal generator 3504. A selector 3508 selects a voltage specified by the voltage selection signal having an expanded amplitude and supplies the selected voltage to a corresponding scanning line 312.

The waveform of the scanning signal supplied from the scanning line driver circuit 350 having the above structure is described below with reference to FIG. 5. As shown in FIG. 5, when a start pulse YD is supplied at the beginning of a vertical scanning period (one frame period), the start pulse YD is shifted every horizontal scanning period 1H in response to the clock signal YCLK, and the resultant signal is output as transferred signals YS1, YS2, . . . , YS240 one by one. Furthermore, the second half of a horizontal scanning period 1H is selected by the control signal INH, and the polarity of the selection voltage during this second half period is determined depending upon the level of the AC driving signal MY. Thus, the voltage of the scanning signal supplied to a certain scanning line 312 becomes equal to the positive selection voltage +VS if the AC driving signal MY is high during the second half of the horizontal scanning period during which that scanning line is selected and thereafter is changed to the positive non-selection voltage +VD/2 in response to the polarity of the selection voltage and maintained at that voltage. In the second half ½H of a horizontal scanning period one frame after that, the AC driving signal MY is inverted to a low level, and thus the voltage of the scanning signal supplied to that scanning line becomes equal to the negative selection voltage −VS. After the end of that second half period, the voltage of the scanning signal is changed to the negative non-selection voltage −VD/2 in response to the polarity of the previous selection voltage and is maintained at that level.

For example, as shown in FIG. 5, the scanning signal Y1 for a scanning line which is first selected in an nth frame has a voltage equal to the positive selection voltage +VS during the second half of that horizontal scanning period. At the end of that second half period, the voltage is changed to the non-selection voltage +VD/2 and maintain at that level. At the beginning of the second half of the first horizontal period of the following (n+I) th frame, the voltage of the scanning signal is changed to the negative selection voltage −VS. At the end of that second half period, the voltage of the scanning signal is changed to the negative non-selection voltage VD/2 and maintained at that level. Thereafter, the above cycle is repeated.

Because the signal level of the AC driving signal MY is inverted every horizontal scanning period 1H, the voltages of the scanning signals applied to adjacent scanning lines become opposite in polarity to each other and are inverted every horizontal scanning period 1H. For example, as shown in FIG. 5, if the scanning signal Y1 applied to the scanning line which is first selected in the nth frame has a voltage equal to the positive selection voltage +VS during the second half of that horizontal scanning period, the scanning voltage Y2 applied to a scanning line which is selected thereafter has a voltage equal to the negative selection voltage −VS during the second half of the horizontal scanning period during which that scanning line is selected.

Figure 6:
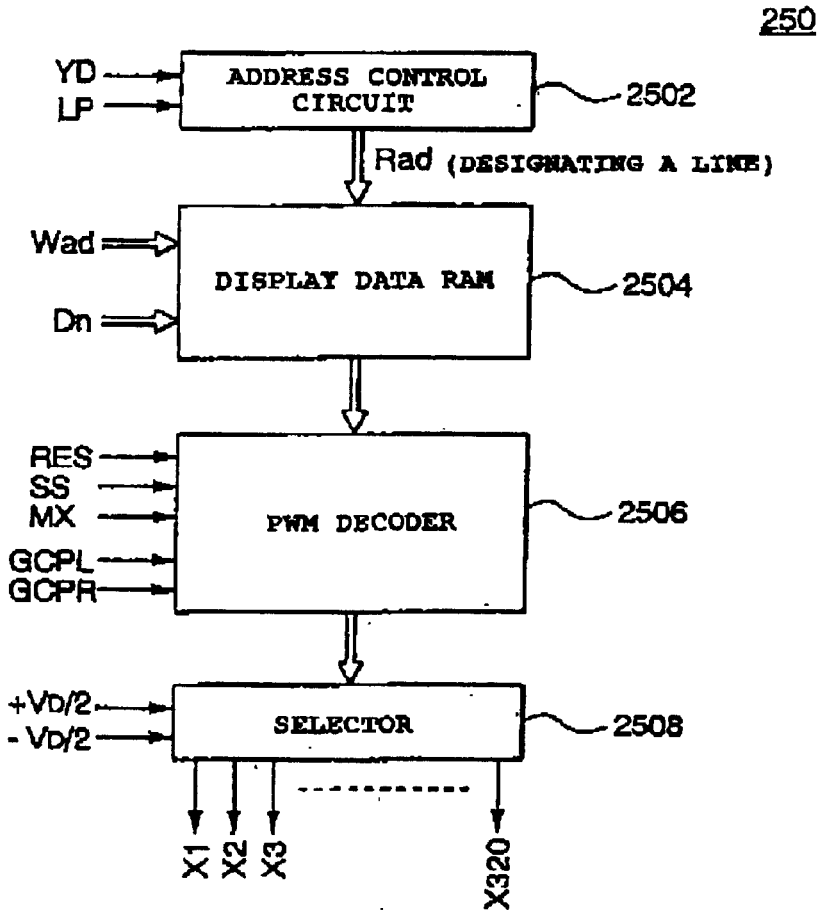
FIG. 6 is an exemplary block diagram illustrating the structure of an X driver of the display device.

The details of the data line driver circuit 250 are described below. FIG. 6 is an exemplary block diagram illustrating the structure of the data line driver circuit 250. In FIG. 6, an address control circuit 2502 generates a row address Rad used in reading of gray level data. In response to a start pulse YD supplied at the beginning of a frame, the address control circuit 2502 resets the row address Rad. Thereafter, the address control circuit 2502 increments the row address Rad in response to a latch pulse LP supplied every horizontal scanning period.

A display data RAM 2504 is a dual port RAM having a memory area corresponding to 240×320 pixels. On a writing side thereof, gray level data Dn supplied from a processing circuit (not shown) is written at an address specified by a write address Wad. On a reading side, one line of gray level data Dn for 320 pixels at an address specified by a row address Rad is read at the same time. A PWM decoder 2506 generates voltage selection signals used to select voltages of data signals X1, X2, . . . , X320 depending upon the 320 gray level data Dn, based on [in accordance with] a reset signal RES, an odd/even signal SS, an AC driving signal MX, a right-side gray level code pulse GCPR, and a left-side gray level code pulse GCPL.

In the present embodiment, the data voltages applied to the data lines 212 are equal to either +VD/2 or −VD/2. On the other hand, each gray level data Dn is represented by 3 bits (8 gray levels) as described earlier. The PWM decoder 2506 generates voltage selection signals so that the voltage levels of the data signals corresponding to the 320 respective gray level data satisfy the following conditions. That is, for one gray level data Dn during a period in which the odd/even signal SS is high (a horizontal scanning period 1H during which an odd-numbered scanning line 312, as counted from the top, is selected), the PWM decoder 2506 generates a voltage selection signal such that the voltage level is inverted to the same level as that of the AC driving signal MX when a right-side gray level code pulse GCPR corresponding to the gray level data Dn falls down.

On the other hand, during a period in which the odd/even signal SS is low (a horizontal scanning period 1H during which an even-numbered scanning line 312, as counted from the top, is selected), the PWM decoder 2506 generates a voltage selection signal such that the voltage level is inverted to the same level as that of the AC driving signal MX when a left-side gray level code pulse GCPL corresponding to the gray level data Dn falls down. However, in the case in which the gray level data Dn has a value of (000) corresponding to white (off), the PWM decoder 2506 generates a voltage selection signal such that the voltage level becomes opposite to that of the AC driving signal MX, while the PWM decoder 2506 generates a voltage selection signal such that the voltage level becomes equal to that of the AC driving signal MX in the case in which the gray level data Dn has a value of (11) corresponding to black (on), using a reset signal RES or the like in either case. The PWM decoder 2506 generates voltage selection signals for the 320 respective gray level data Dn.

A selector 2508 selects a voltage specified by the voltage selection signal generated by the PWM decoder 2506 and supplies the selected voltage to a corresponding data line 212 one by one.

The waveform of the data signal supplied from the data line driver circuit 250 having the above structure is described below with reference to FIG. 7. As shown in FIG. 7, when the gray level data has a value other than (000) and (111), and when the odd/even signal SS is at the high level, the voltage level of the data signal Xi is inverted to the same level as that of the AC driving signal MX when a right-side gray level code pulse GCPR corresponding to that gray level data falls down. However, when the odd/even signal SS is at the low level, the voltage level of the data signal Xi is inverted to the same level as that of the AC driving signal MX when a left-side gray level code pulse GCPL corresponding to that gray level data falls down. In the case in which the gray level data is equal to (000), the data signal Xi has a voltage level opposite to that of the AC driving signal MX. On the other hand, when the gray level data is equal to (111), the data signal Xi has the same voltage level as that of the AC driving signal MX.

As a result, in a period corresponding to one horizontal scanning period 1H, the data signal Xi has a voltage level equal to the positive data voltage +VD/2 during a period with the same length as a period during which the data signal Xi has a voltage level equal to the negative data voltage −VD/2, regardless of the value of the gray level data, and thus the problem of crosstalk does not occur.

Furthermore, during the second half period ½H of a horizontal scanning period, the AC driving signal MX which determined the polarity of the data signal Xi has a voltage level opposite to that of the AC driving signal MY which determines the polarity of the scanning signal during the same second half period, and thus the polarity of the data signal Xi corresponds to that of the scanning signal.

In the display device according to the present embodiment, as shown in FIG. 8, when a scanning line 312 in an odd-numbered row is selected, a gray level is represented by the right-side modulation, while a gray level is represented by the left-side modulation when a scanning line 312 in an even-numbered row is selected. Therefore, when a pixel 116 located on a data line 212 in an ith column has a certain gray level, the number of times the voltage level of the data signal Xi is switched in a horizontal scanning period 1H is reduced to two. Therefore, in the display device according to the present embodiment, electric power consumed when a gray-scale image is displayed becomes as small as ⅔ times that consumed in the conventional display device using only the right-side modulation.

In the present embodiment, when a scanning line 312 in an odd-numbered row is selected, a gray level is represented by the right-side modulation, while a gray level is represented by the left-side modulation when a scanning line 312 in an even-numbered row is selected. Alternatively, when a scanning line 312 in an odd-numbered row is selected, a gray level may be represented by the left-side modulation, while a gray level may be represented by the right-side modulation when a scanning line 312 in an even-numbered row is selected.

Figure 10:
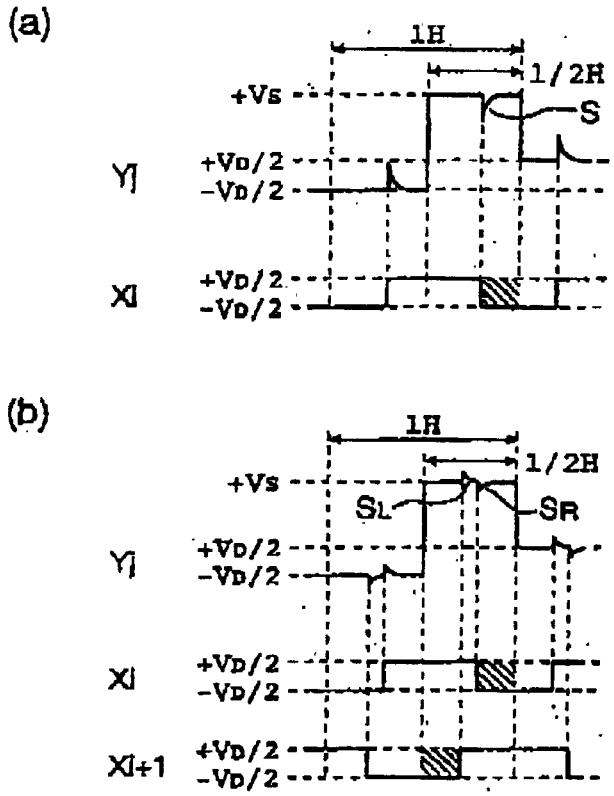
FIGS. 10(*a*) and 10(*b*) are diagrams illustrating spikes appearing in the respective display devices according to the embodiment and modified embodiment.

In the embodiment described above, because the scanning lines 312 are formed of metal, such as ITO, having rather large resistivity, a combination of the resistance thereof and the capacitances CT and CLC equivalently behaves as a differentiating circuit. As a result, as shown in FIG. 10(*a*), rather large differentiating noise is generated in the scanning signal Yj when the voltage of the data signal Xi is switched. Of noise generated at various times, differential noise S generated in a period during which a selection voltage is applied according to the right-side modulation directly affects the effective voltage value applied to the liquid crystal layer 118, and thus the written voltage deviates from a correct value.

In the above-described embodiment, when a scanning line 312 in an odd-numbered row is selected, all data signals X1, X2, . . . , X320 applied to the respective data lines 212 are on the basis of the right-side modulation. Therefore, when many of 320 pixels 116 located along that scanning line 312 are at the same intermediate gray level, many of the data signals X1, X2, . . . , X320 are switched in voltage level at the same time, and extremely large differentiating noise is generated in the scanning signal Yj in a period during which a selection voltage is applied. As a result, the voltages applied to the 320 pixels 116 at locations corresponding to that scanning line 312 become very different from correct voltages. Thus, the intensities of these pixels become different from those of pixels at adjacent scanning lines 312. This results in degradation in the image quality.

Figure 9:
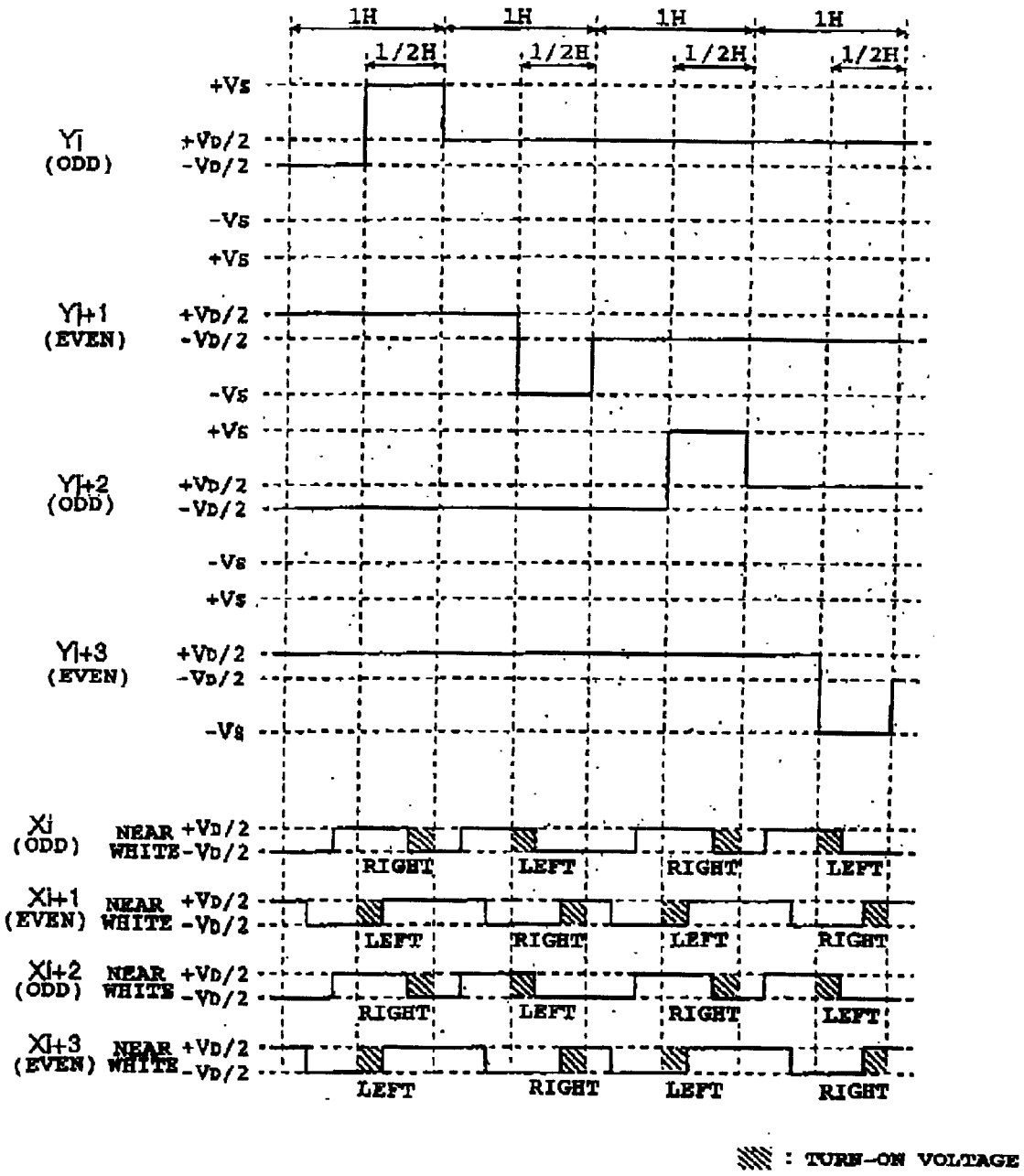
FIG. 9 is a timing chart illustrating waveforms associated with a driving operation of the X driver, according to a modified embodiment of the present invention.

The above-described degradation in the image quality can be prevented according to a modified embodiment as described below. In a display device according to this modified embodiment, as shown in FIG. 9, when a scanning line 312 in an odd-numbered row is selected, the gray level of a data signal applied to a data line 212 in an odd-numbered column is displayed using the right-side modulation, while the gray level of a data signal applied to a data line 212 in an even-numbered column is displayed using the left-side modulation. Conversely, when a scanning line 312 in an even-numbered row is selected, the gray level of a data signal applied to a data line 212 in an odd-numbered column is displayed using the left-side modulation, while the gray level of a data signal applied to a data line 212 in an even-numbered column is displayed using the right-side modulation.

This can be achieved simply by modifying the PWM decoder 2506 (shown in FIG. 6) such that when voltage selection signals are generated in inverted manners in which the selection voltages generated in response to the right-side modulation code pulse GCPR and the left-side modulation code pulse GCPL depending upon whether the selection voltage is for a data line 212 in an odd-numbered column or for a data line 212 in an even-numbered column. More specifically, the PWM decoder 2506 generates voltage selection signals as follows.

That is, for one gray level data Dn in an odd-numbered column in a period during which the odd/even signal SS is at the high level, if the gray level data Dn has a value other than (111) corresponding to black and (000), the PWM decoder 2506 generates a voltage selection signal such that the voltage level is inverted to the same level as that of the AC driving signal MX when a right-side gray level code pulse GCPR corresponding to the gray level data Dn falls down. On the other hand, for gray level data Dn in an even-numbered column, if the gray level data Dn has a value other than (111) corresponding to black and (000), the PWM decoder 2506 generates a voltage selection signal such that the voltage level is inverted to the same level as that of the AC driving signal MX when a right-side gray level code pulse GCPR corresponding to the gray level data Dn falls down.

Conversely, for one gray level data Dn in an odd-numbered column in a period during which the odd/even signal SS is at the low level, if the gray level data Dn has a value other than (111) corresponding to black and (000), the PWM decoder 2506 generates a voltage selection signal such that the voltage level is inverted to the same level as that of the AC driving signal MX when a left-side gray level code pulse GCPL corresponding to the gray level data Dn falls down. On the other hand, for gray level data Dn in an even-numbered column, if the gray level data Dn has a value other than (111) corresponding to black and (000), the PWM decoder 2506 generates a voltage selection signal such that the voltage level is inverted to the same level as that of the AC driving signal MX when a right-side gray level code pulse GCPR corresponding to the gray level data Dn falls down.

In this modified embodiment, when a scanning line 312 in an odd-numbered row is selected, even if the 320 pixels 116 corresponding to that scanning line 312 are all at the same intermediate gray level, the voltage levels of data signals applied to data lines 212 in odd-numbered columns are switched at times determined by the right-side modulation, while the voltage levels of data signals applied to data lines 212 in even-numbered columns are switched at times determined by the left-side modulation. Therefore, as shown in FIG. 10(*b*), the number of differentiating noise generated in a period during which a selection voltage is applied to the scanning signal Yj decreases to 2 as represented by SR and SL. Moreover, the number of data lines which are switched in voltage level at the same time is reduced to 160. Therefore, in the display device according to this modified embodiment, degradation in the image quality due to differentiating noise in the scanning signal Yj is suppressed.

In this modified embodiment, alternatively, when a scanning line 312 in an odd-numbered row is selected, the gray level of a data signal applied to a data line 212 in an odd-numbered column may be displayed using the left-side modulation, while the gray level of a data signal applied to a data line 212 in an even-numbered column may be displayed using the right-side modulation. Conversely, when a scanning line 312 in an even-numbered row is selected, the gray level of a data signal applied to a data line 212 in an odd-numbered column may be displayed using the right-side modulation, while the gray level of a data signal applied to a data line 212 in an even-numbered column may be displayed using the left-side modulation.

Instead of controlling the data signals applied to the data lines 212 on the basis of whether a data line 212 of interest in an odd-numbered or even-numbered column, the right-side modulation and the left-side modulation may be alternately applied to every plural number of columns. Alternatively, the data signals for the data lines on the left side (from 1 st to 160th column as counted from the leftmost column) may be generated according to the right-side modulation to represent gray levels, and the data signals for the data lines on the right side (from 161st to 320th column as counted from the leftmost column) may be generated according to the left-side modulation to represent gray levels.

Although in the above-described embodiment and modified embodiment, the selection voltage +VS or −VS is applied only during the second half of each horizontal scanning period, the selection voltage +VS or −VS may be applied only during the first half of each horizontal scanning period. Furthermore, although in the above-described embodiment and modified embodiment, the left-side modulation or the right-side modulation is uniquely selected depending upon a scanning line 312 of interest is in an odd-numbered or even-numbered row, the manner of selecting the left-side modulation or the right-side modulation may be inverted every one or more vertical scanning periods. Although in the above-described modified embodiment, the left-side modulation or the right-side modulation is uniquely selected depending upon a data line 312 of interest is in an odd-numbered or even-numbered column, the manner of selecting the left-side modulation or the right-side modulation may be inverted every one or more vertical scanning periods without departing from the spirit and scope of the present invention.

In FIG. 1, each TFD 220 is connected to a corresponding data line 212, and each liquid crystal layer 118 is connected to a corresponding scanning line 312. Alternatively, each TFD 220 may be connected to a scanning line 312, and each liquid crystal layer 118 may be connected to a data line 212.

The TFDs 220 used as switching elements in the liquid crystal panel 100 may be replaced with another type of two-terminal switching elements such as a ZnO (zinc oxide) varister, an MSI (Metal Semi-Insulator) element, a series or parallel connection of two such elements in opposite directions, or a three-terminal element such as a TFT (Thin Film Transistor) or an insulating gate field effect transistor.

In the case in which TFTs are employed as the switching elements, TFTs may be formed, for example, by first forming a thin silicon film on the surface of the device substrate 200, and then forming sources, drains, and channels in the thin silicon film. In the case in which insulating gate field effect transistors are employed as the switching elements, they may be formed, for example, by employing a semiconductor substrate as the device substrate 200 and forming sources, drains, and channels on the surface of the semiconductor substrate. In this case, however, because the semiconductor substrate is not transparent to light, the pixel electrodes 234 are formed of metal, such as aluminum, such that the pixel electrodes 234 serve as reflective electrodes, and thus the resultant display device serves as a reflective type display device.

In the case in which three-terminal elements are used as the switching elements, not only either the data lines 212 or the scanning lines 312 are formed on the device substrate 200, but both the data lines 212 and the scanning lines 213 are needed on the device substrate 200 such that they cross each other on the same device substrate 200. This results in an increase in the risk of forming of a short-circuit path. Furthermore, TFTs are more complicated in structure than TFDs, and thus a more complicated production process is needed to produce TFTs.

The present invention may also be applied to a passive liquid crystal display which uses STN (Super Twisted Nematic) liquid crystal and which does not need switching elements such as TFDs or TFTs. The pixel electrodes 234 may be formed of reflective metal or an additional reflecting layer may be formed under the pixel electrodes 234 so that the display device serves as a reflective device. Furthermore, the reflecting layer may be formed so as to be very thin so that the display device serves as a transflective device.

In the display device described above, a liquid crystal is used as the electrooptical material. The present invention may also be applied to a display device which displays an image using an electrooptical effect, such as an electroluminescence display, a fluorescent display tube, or a plasma display.

That is, the present invention may be applied to any display device having a similar structure to that described above.

Some specific examples of electronic devices using the above-described display device are described below.

Figure 18:
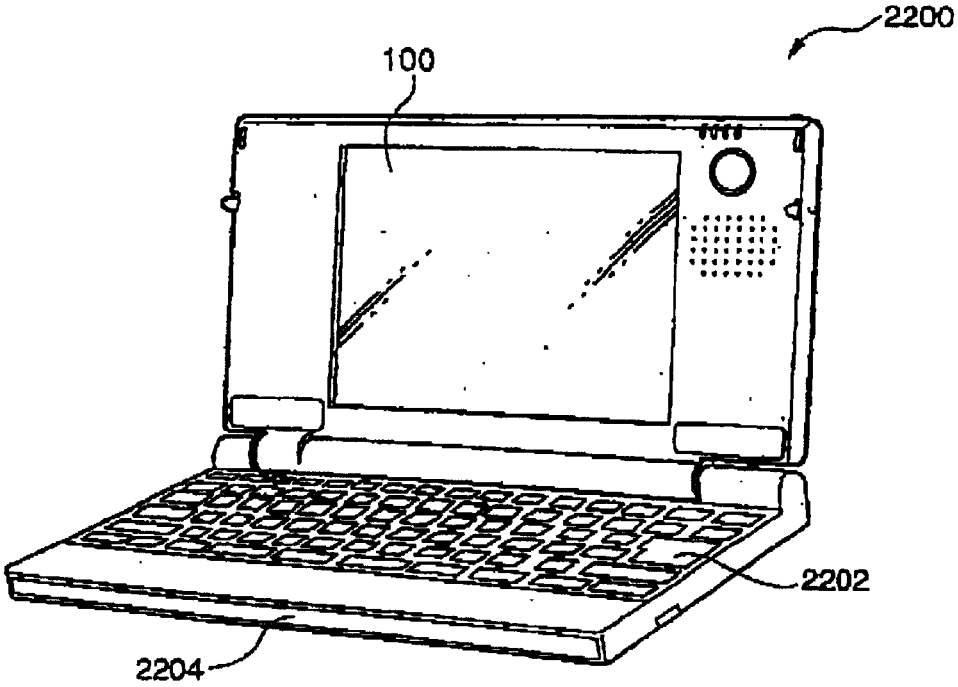
FIG. 18 is a perspective view illustrating a structure of a personal computer which is an example of an electronic device using the display device.

An example of a mobile personal computer using the above-described display device as its display is described below. FIG. 18 is a perspective view illustrating the structure of the personal computer. In FIG. 18, the personal computer 2200 includes a main part 2204 having a keyboard 2202 and a liquid crystal panel 100 serving as a display. Although a backlight device is disposed on the back of the liquid crystal panel 100 to achieve good visibility, it cannot be viewed from the outside, and thus it is not shown in FIG. 18.

Figure 19:
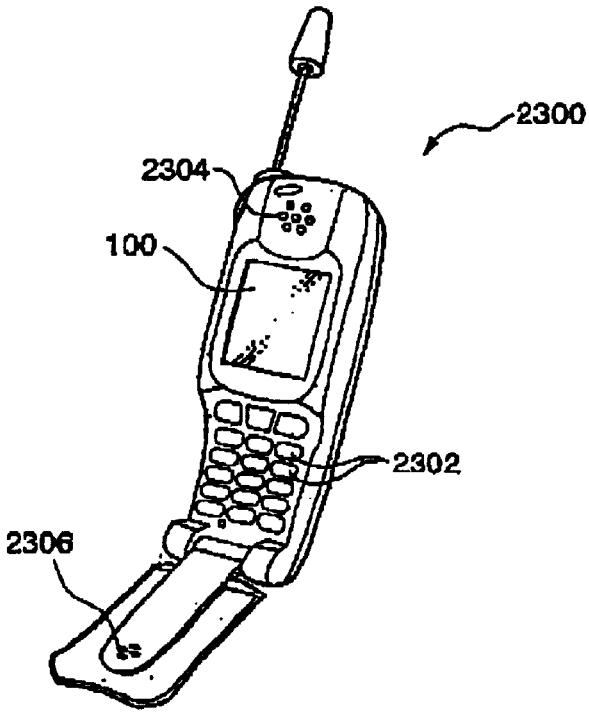
FIG. 19 is a perspective view illustrating a structure of a portable telephone which is an example of an electronic device using the display device.

An example of a portable telephone using the above-described display device as its display is described below. FIG. 19 is a perspective view illustrating the structure of the portable telephone. In FIG. 19, the portable telephone 2300 includes a plurality of operation control buttons 2302, an earpiece 2304, a mouthpiece 2306, and the above-described liquid crystal panel 100. Also in this portable telephone, a backlight device is disposed on the back of the liquid crystal panel 100 to achieve good visibility, it cannot be viewed from the outside, and thus it is not shown in FIG. 19.

Figure 20:
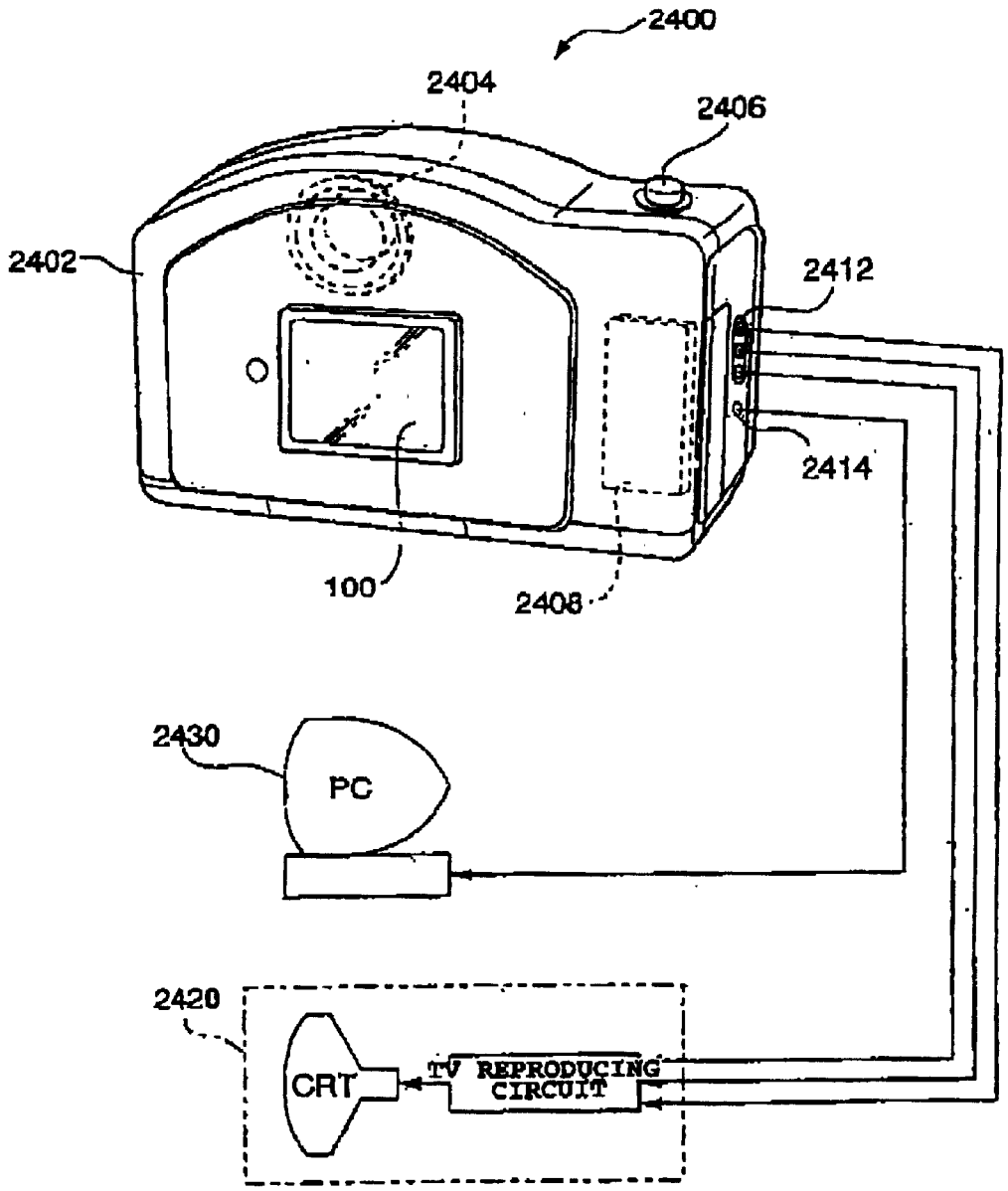
FIG. 20 is a perspective view illustrating a structure of a digital still camera which is an example of an electronic device using the display device.

An example of a digital still camera using the above-described display device as its viewfinder is described below. FIG. 20 is a perspective view illustrating the structure of the digital still camera, wherein external devices connected to the digital still camera are also shown.

In conventional cameras, a film is exposed to an optical image of a subject. In contrast, in the digital still camera 2400, an optical image of a subject is converted into an electric signal by an imaging device such as a CCD (Charge Coupled Device) thereby producing an image signal. The digital still camera 2400 includes the above-described liquid crystal panel 100 disposed on the back of a case 2402 so that an image is displayed on the liquid crystal panel 100 in accordance with the image signal output from the CCD and thus the liquid crystal panel 100 serves as a viewfinder for displaying an image of a subject. A photo sensing unit 2404 including an optical lens and the CCD is disposed on the front side (back side in FIG. 20) of the case 2402.

When a human operator decides to take a picture displayed on the liquid crystal panel 100, he/she presses a shutter button 2406. In response, the image signal produced by the CCD at that moment is transferred to a memory on a circuit board 2408 and stored therein. In this digital still camera 2400, a video signal output terminal 2412 and a data communication input/output terminal 2414 are disposed on a side face of the case 2402. As shown in FIG. 20, as required, a television monitor 2420 can be connected to the video signal output terminal 2412 and a personal computer 2430 can be connected to the data communication input/output terminal 2414. If a predetermined operation is performed, the image signal stored in the memory on the circuit board 2408 is output to the television monitor 2420 or the personal computer 2430.

In addition to the personal computer shown in FIG. 18, the portable telephone shown in FIG. 19, and the digital still camera shown in FIG. 20, the display device according to the present invention may also be used in other various electronic devices such as a liquid crystal television, a video tape recorder with a viewfinder or a monitor, a car navigation device, a pager, an electronic notepad, a calculator, a word processor, a workstation, a video telephone, a POS terminal, and a device including a touch panel.

According to the present invention, as described above, it is possible to reduce the number of times the voltage levels of signals applied to the data lines are switched in an operation of displaying a gray-scale image. As a result, a reduction in electric power consumed when the voltage levels are switched can be achieved.

What is claimed is:

1. A method of driving a display device so as to display a gray-scale image by driving pixels disposed at locations corresponding to respective intersections of a plurality of scanning lines extending along rows and a plurality of data lines extending along columns, said method comprising:

sequentially selecting said plurality of scanning lines one by one every horizontal scanning period;

applying a selection voltage to a selected scanning line during one of two half periods that said horizontal scanning period has been divided into; and applying a voltage to a pixel such that:

in the case in which, of said plurality of scanning lines, a scanning line in either an odd-numbered or an even-numbered row is selected, a turn-on or a turn-off voltage is applied to a pixel at a location corresponding to an intersection of said scanning line and a data line belonging to a first group such that in one of said two half periods of each horizontal scanning period the turn-on voltage is applied via said data line to said pixel during a period from the start of one of the two half periods of the horizontal scanning period until a time corresponding to a gray level has elapsed, and the turn-off voltage is applied to said pixel during a remaining period of said one of the two half periods, while, in the case in which, of said plurality of scanning lines, a scanning line in the other one of odd-numbered and even-numbered rows is selected, the turn-on or the turn-off voltage is applied to the pixel at the location corresponding to the intersection of said scanning line and the data line belonging to the first group such that the turn-on voltage is applied via said data line to said pixel during a period from a point of time earlier than the end of said one of the half periods of the horizontal scanning period by an amount of time corresponding to a gray level until the end of said one of the two half periods, and the turn-off voltage is applied to said pixel during remaining period of said one of the two half periods, and in either of these cases, in the other of said two half periods of said horizontal scanning period, the turn-on voltage is applied during a period equal to the period in which the turn-off voltage is applied in said one of the two half periods, while the turn-off voltage is applied during a period equal to the period in which the turn-on voltage is applied in said one of the two half periods.

2. The method of driving a display device according to claim 1, wherein the data lines belonging to said first group is all of said plurality of data lines.

3. The method of driving a display device according to claim 1, wherein in the case in which a scanning line in either an odd-numbered or an even-numbered row is selected, the turn-on or the turn-off voltage is applied to a pixel at a location corresponding to the intersection of said scanning line and a data line not belonging to the first group such that:

in one of said two half periods of each horizontal scanning period, the turn-on voltage is applied via said data line to the pixel during a period from a point of time earlier than the end of said one of the two half periods of the horizontal scanning period by an amount of time corresponding to a gray level until the end of said one of the two half period, and the turn-off voltage is applied to said pixel during the remaining period of said one of the two half periods, while, in the case in which a scanning line in the other one of odd-numbered and even-numbered rows is selected, the turn-on or the turn-off voltage is applied to the pixel at the location corresponding to the intersection of said scanning line and the data line not belonging to the first group such that the turn-on voltage is applied via said data line to said pixel during a period from the start of one of the two half periods of the horizontal scanning period until a time corresponding to a gray level has elapsed, and the turn-off voltage is applied to said pixel during the remaining period of said one of the half periods, and in either of these cases, in the other of said two half periods of said horizontal scanning period, the turn-on voltage is applied during a period equal to the period in which the turn-off voltage is applied in said one of the two half periods, while the turn-off voltage is applied during a period equal to the period in which the turn-on voltage is applied in said one of the two half periods.

4. The method of driving a display device according to claim 1, wherein the number of data lines belonging to said first group is equal to or substantially equal to the number of data lines not belonging to said first group.

5. The method of driving a display device according to claim 4, wherein the data lines belonging to said first group are those data lines, of said plurality of data lines, located in either odd-numbered columns or even-numbered columns.

6. A driver circuit for driving a display device so as to display a gray-scale image by driving pixels disposed at locations corresponding to respective intersections of a plurality of scanning lines extending along rows and a plurality of data lines extending along columns, said driver circuit comprising:

a scanning line driver circuit that:

sequentially select said plurality of scanning lines one by one every horizontal scanning period, and applies a selection voltage to a selected scanning line during one of two half periods that said horizontal scanning period has been divided into; and a data line driver circuit that applies a voltage to a pixel such that:

in the case in which, of said plurality of scanning lines, a scanning line in either an odd-numbered or an even-numbered row is selected, a turn-on or a turn-off voltage is applied to a pixel at a location corresponding to an intersection of said scanning line and a data line belonging to a first group, such that in one of said half periods of each horizontal scanning period, the turn-on voltage is applied via said data line to said pixel during a period from the start of one of the two half periods of the horizontal scanning period until a time corresponding to a gray level has elapsed, and the turn-off voltage is applied to said pixel during the remaining period of said one of the two half periods, while, in the case in which, of said plurality of scanning lines, a scanning line in the other one of odd-numbered and even-numbered rows is selected, the turn-on or the turn-off voltage is applied to the pixel at the location corresponding to the intersection of said scanning line and the data line belonging to the first group such that the turn-on voltage is applied via said data line to said pixel during a period from a point of time earlier than the end of said one of the two half periods of the horizontal scanning period by an amount of time corresponding to a gray level until the end of said one of the two half periods, and the turn-off voltage is applied to said pixel during the remaining period of said one of the half periods, and in either of these cases, in the other of said half periods of said horizontal scanning period, the turn-on voltage is applied during a period equal to the period in which the turn-off voltage is applied in said one of the two half periods, while the turn-off voltage is applied during a period equal to the period in which the turn-on voltage is applied in said one of the two half periods.

7. A display device comprising a pair of substrates, an electrooptical material disposed between said pair of substrates, a plurality of scanning lines formed on one of said pair of substrates, a plurality of data lines formed on the other one of said pair of substrates, and pixels disposed at locations corresponding to intersections of said plurality of scanning lines and said plurality of data lines, said display device serving to display a gray-scale image by driving said pixels, said display device further comprising:

a scanning line driver circuit that:

sequentially selects said plurality of scanning lines one by one every horizontal scanning period, and applies a selection voltage to a selected scanning line during one of two half periods that said horizontal scanning period has been divided into; and a data line driving circuit that applies a voltage to a pixel such that:

in the case in which, of said plurality of scanning lines, a scanning line in either an odd-numbered or an even-numbered row is selected, a turn-on or a turn-off voltage is applied to a pixel at a location corresponding to an intersection of said scanning line and a data line belonging to a first group, such that in one of said half periods of each horizontal scanning period, the turn-on voltage is applied via said data line to said pixel during a period from the start of one of the two half periods of the horizontal scanning period until a time corresponding to a gray level has elapsed, and the turn-off voltage is applied to said pixel during the remaining period of said one of the two half periods, while, in the case in which, of said plurality of scanning lines, a scanning line in the other one of odd-numbered and even-numbered rows is selected, the turn-on or the turn-off voltage is applied to the pixel at the location corresponding to the intersection of said scanning line and the data line belonging to the first group such that the turn-on voltage is applied via said data line to said pixel during a period from a point of time earlier than the end of said one of the two half periods of the horizontal scanning period by an amount of time corresponding to a gray level until the end of said one of the two half period, and the turn-off voltage is applied to said pixel during the remaining period of said one of the two half periods, and in either of these cases, in the other of said two half periods of said horizontal scanning period, the turn-on voltage is applied during a period equal to the period in which the turn-off voltage is applied in said one of the two half periods, while the turnoff voltage is applied during a period equal to the period in which the turn-on voltage is applied in said one of the two half periods.

8. The display device according to claim 7, wherein:

said pixel includes a switching element and a capacitor formed of said electrooptical material; and said capacitor is driven by said switching element.

9. The display device according to claim 8, wherein said switching element is a thin film diode having a conductor/insulation/conductor structure, one end of said thin film diode being connected to either said scanning line or said data line and the other end being connected to said capacitor.

10. An electronic device including a display device according to claim 7.

* * * * *